US010068527B2

(12) United States Patent
Kumeta et al.

(10) Patent No.: US 10,068,527 B2
(45) Date of Patent: Sep. 4, 2018

(54) LIGHT-EMITTING DISPLAY APPARATUS AND DRIVING METHOD THEREOF

(71) Applicant: SAMSUNG DISPLAY CO., LTD., Yongin-si, Gyeonggi-do (KR)

(72) Inventors: Masayuki Kumeta, Yokohama (JP); Takeshi Okuno, Yokohama (JP); Eiji Kanda, Yokohama (JP); Ryo Ishii, Yokohama (JP); Naoaki Komiya, Yokohama (JP)

(73) Assignee: SAMSUNG DISPLAY CO., LTD., Yongin, Gyunggi-do (KR)

( * ) Notice: Subject to any disclaimer, the term of this patent is extended or adjusted under 35 U.S.C. 154(b) by 189 days.

(21) Appl. No.: 15/255,528

(22) Filed: Sep. 2, 2016

(65) Prior Publication Data

US 2017/0004774 A1 Jan. 5, 2017

Related U.S. Application Data

(63) Continuation of application No. 14/321,002, filed on Jul. 1, 2014, now Pat. No. 9,437,136.

(30) Foreign Application Priority Data

Jul. 1, 2013 (JP) ..... 2013-138160

(51) Int. Cl.
*G09G 3/14* (2006.01)
*G09G 3/3233* (2016.01)
(Continued)

(52) U.S. Cl.
CPC ..... *G09G 3/3258* (2013.01); *G09G 3/2007* (2013.01); *G09G 3/3233* (2013.01);
(Continued)

(58) Field of Classification Search
CPC ..... G09G 3/22; G09G 3/3208; G09G 3/30; G09G 3/3225; G09G 3/3233;
(Continued)

(56) References Cited

U.S. PATENT DOCUMENTS 8,537,077 B2 * 9/2013 Lee ..... G09G 3/3233 315/169.3
2006/0022305 A1 * 2/2006 Yamashita ..... G09G 3/2014 257/565
(Continued)

FOREIGN PATENT DOCUMENTS

JP 2006-018312 A 1/2006
JP 2008-241832 A 10/2008
(Continued)

*Primary Examiner* — William Lu
(74) *Attorney, Agent, or Firm* — Lee & Morse, P.C.

(57) ABSTRACT

A pixel includes five transistors and a capacitor. A first transistor controls current to be supplied to a light-emitting element. A second transistor is connected between a gate electrode of the first transistor and a first power supply. A third transistor is connected between the gate electrode of the first transistor and a second terminal of the first transistor. The capacitor is coupled between the third transistor and the second terminal of the first transistor. The fourth transistor is connected between the second terminal of the first transistor and a second power supply. The fifth transistor is connected between the second terminal of the third transistor and a signal line. The capacitor may be the only capacitor in the pixel, and the signal line may receive an initialization voltage and a gray scale data voltage.

20 Claims, 25 Drawing Sheets

(51) Int. Cl.
*G09G 3/3258* (2016.01)
*G09G 3/20* (2006.01)
*G09G 3/3291* (2016.01)

(52) U.S. Cl.
CPC ..... *G09G 3/3291* (2013.01); *G09G 2300/043* (2013.01); *G09G 2300/0809* (2013.01); *G09G 2300/0819* (2013.01); *G09G 2300/0842* (2013.01); *G09G 2310/0262* (2013.01); *G09G 2320/045* (2013.01)

(58) Field of Classification Search
CPC .. G09G 3/3241; G09G 3/3266; G09G 3/3275; G09G 3/3258
See application file for complete search history.

(56) References Cited

U.S. PATENT DOCUMENTS

2006/0022605 A1* 2/2006 Ha ..... G09G 3/3233 315/169.3
2006/0231740 A1* 10/2006 Kasai ..... G09G 3/3233 250/214.1
2007/0001958 A1* 1/2007 Lee ..... G09G 3/325 345/92
2007/0040772 A1* 2/2007 Kim ..... G09G 3/3233 345/76
2007/0103406 A1* 5/2007 Kim ..... G09G 3/3233 345/76
2009/0219232 A1* 9/2009 Choi ..... G09G 3/3233 345/76
2011/0084958 A1* 4/2011 Choi ..... G09G 3/3233 345/213
2011/0193855 A1* 8/2011 Han ..... G09G 3/3233 345/214
2011/0227889 A1* 9/2011 Choi ..... G09G 3/3233 345/209
2012/0146979 A1* 6/2012 Kim ..... G09G 3/3233 345/211
2015/0221251 A1* 8/2015 Wang ..... G09G 3/3233 345/690

FOREIGN PATENT DOCUMENTS

JP 2010-145579 A 7/2010
JP 2010-250111 A 11/2010
JP 2011-034039 A 2/2011

* cited by examiner

DT = VINIT
SCAN = ON Level(Low)
EM = OFF Level(High)
INIT = ON Level(Low)

(a) Initialization

DT = VDATA
SCAN = ON Level(Low)
EM = OFF Level(High)
INIT = OFF Level(High)

(b) VTH Compensation + Data Program

DT = VINIT or VDATA
SCAN = OFF Level(High)
EM = ON Level(Low)
INIT = ON Level(Low)

(c) Light-Emitting (a) Initialization
(b) VTH Compensation + Data Program
(c) Light-Emitting DT = VINIT
SCAN = ON Level(Low)
EM = OFF Level(High)
ELVSS = VRES (High)

(a) Initialization

DT = VINIT
SCAN = ON Level(Low)
EM = OFF Level(High)
ELVSS = ELVSS(Low)

(b) VTH Compensation

DT = VDATA
SCAN = ON Level(Low)
EM = OFF Level(High)
ELVSS = ELVSS(Low)

(c) Data Program

DT = VINIT or VDATA
SCAN = OFF Level(High)
EM = ON Level(Low)
ELVSS = ELVSS(Low)

(d) Light-Emitting (a) Initialization
(b) VTH Compensation + Data Program
(c) Light-Emitting

FIG. 20

| | Display Mode 1 | Display Mode 2 |
|---|---|---|
| Driving Manner | Progressive Driving | Simultaneous Driving |
| Display State(2D/3D) | Two-Dimensional Display(2D) | Three-Dimensional Display(3D) |
| Transmissivity of Shutter Glasses | Transmission(100%) Fixed | Transmission(100%) / Non-Transmission(0%) |

LIGHT-EMITTING DISPLAY APPARATUS AND DRIVING METHOD THEREOF

CROSS-REFERENCE TO RELATED APPLICATIONS

This is a continuation application based on pending application Ser. No. 14/321,002, filed Jul. 1, 2014, the entire contents of which is hereby incorporated by reference.

Japanese Patent Application No. 2013-138160, filed on Jul. 1, 2013, and entitled: "Light-Emitting Display Apparatus and Driving Method Thereof," is incorporated by reference herein in its entirety.

BACKGROUND

1. Field

One or more embodiments described herein relate to a light-emitting display apparatus and a method for driving the apparatus.

2. Description of the Related Art

A variety of flat panel displays, such as liquid crystal displays and organic EL displays, have replaced CRT displays for the most part. Organic EL displays are low-power, thin displays having a luminance that varies based on current flowing into organic EL elements in each pixel. In an active matrix panel, this current may vary due to variations in thin film transistor (TFT) characteristics, e.g., variations in the threshold voltages of the TFTs. As a result, the brightness of each pixel may vary to thereby lower display quality.

SUMMARY

In accordance with one embodiment, a method for driving a display apparatus, the method comprising charging an initialization voltage in a capacitive element of a pixel circuit; charging the capacitive element with a first data voltage determined based on a gray scale data voltage and a threshold voltage of a first transistor in the pixel circuit; and supplying a light-emitting element in the pixel circuit with current, corresponding to the first data voltage charged in the capacitive element, for causing the light-emitting element to emit light, wherein the first transistor controls a magnitude of the current supplied to the light-emitting element, and wherein the pixel circuit includes: a second transistor connected between a gate electrode of the first transistor and a first power supply, a third transistor having a first terminal connected to the gate electrode of the first transistor and a second terminal connected to a second terminal of the first transistor via the capacitive element, a fourth transistor connected between the second terminal of the first transistor and a second power supply, and a fifth transistor connected between the second terminal of the third transistor and a signal line supplied with the initialization voltage and the gray scale data voltage.

The method may include charging the capacitive element with a voltage determined according to the threshold voltage before charging the capacitive element with the first data voltage.

Charging the capacitive element with the voltage determined according to the threshold voltage may be performed multiple times between charging the initialization voltage in the capacitive element and the light-emitting of the light-emitting element.

Charging of the initialization voltage in the capacitive element may include turning off the third transistor; turning on the second transistor after the third transistor is turned off; supplying a voltage at the first power supply for turning off the first transistor to the gate electrode of the first transistor, and turning on the fourth and fifth transistors such that a voltage at the second power supply and the initialization voltage are supplied to both terminals of the capacitive element.

Another terminal of the light-emitting element may be connected to a third power supply, and charging the initialization voltage in the capacitive element may include turning off the third transistor; turning on the fifth transistor after the third transistor is turned off; supplying a voltage at the third power supply to one terminal of the capacitive element, turning on the second transistor, and supplying a voltage at the first power supply to the gate electrode of the first transistor, and wherein a voltage at the third power supply is varied, the first transistor is turned on by capacitive coupling of a capacitance of the light-emitting element, and the initialization is charged in the capacitive element.

After charging the initialization voltage in the capacitive element and the first power supply voltage is varied, the method may include turning off the first transistor and charging the capacitive element with the voltage determined according to the threshold voltage.

During a period of charging the first data voltage, the method may include supplying the gray scale data voltage to the capacitive element via the fifth transistor and charging the first data voltage in the capacitive element.

During emission of the light-emitting element, the method may include turning on the third transistor after the second and fifth transistors are turned off, and turning on the fourth transistor after the third transistor is turned on.

The display apparatus may include a plurality of pixel circuits in a matrix, and wherein the method may include driving the pixel circuits in a progressive manner by sequentially performing a non-light-emitting operation and a light-emitting operation by rows, the non-light emitting operation including charging the capacitive element with the initialization voltage and charging the first data voltage, and the light-emitting operation including the light-emitting of the light-emitting element.

The display apparatus may include a plurality of pixel circuits in a matrix, and wherein the method may include driving the pixel circuits in a simultaneous manner which includes performing a non-light-emitting operation and a light-emitting operation for all pixels, the non-light emitting operation including charging the capacitive element with the initialization voltage and charging the first data voltage, and the light-emitting operation including the light-emitting of the light-emitting element.

The display apparatus may include a plurality of pixel circuits arranged in a matrix, and wherein the method may include switching between a progressive driving method and a simultaneous driving method based on an input switch signal, the progressive driving method including a non-light-emitting operation sequentially performed by rows and a light-emitting operation, the non-light-emitting operation including charging the capacitive element with the initialization voltage and charging the first data voltage, and the light-emitting operation including light-emitting of the light-emitting element, and the simultaneous driving method including a non-light-emitting operation and a light-emitting operation performed for all pixels, the non-light emitting operation including charging the capacitive element with the initialization voltage and charging the first data voltage, and the light-emitting operation including light-emitting of the light-emitting element.

In accordance with another embodiment, a light-emitting display apparatus may include a light-emitting element including a parasitic capacitance, the light-emitting element to emit light having a gray scale value based on a supplied current; a first transistor to control a magnitude of current to be supplied to the light-emitting element, and having a first terminal connected to one terminal of the light-emitting element; a second transistor connected between a gate electrode of the first transistor and a first power supply; a third transistor having a first terminal connected to the gate electrode of the first transistor and a second terminal connected to a second terminal of the first transistor via a capacitive element; a fourth transistor connected between the second terminal of the first transistor and a second power supply; and a fifth transistor connected between the second terminal of the third transistor and a signal line to receive an initialization voltage and a gray scale data voltage.

A voltage of the first power supply and a voltage of the second power supply may be supplied via a same power line. A gate electrode of the third transistor and a gate electrode of the fourth transistor may be connected to a same control line. A gate electrode of the second transistor and a gate electrode of the fifth transistor may be connected to a same control line.

In accordance with another embodiment, a pixel may include a first transistor to control a magnitude of current to be supplied to a light-emitting element; a second transistor connected between a gate electrode of the first transistor and a first power supply; a third transistor connected between the gate electrode of the first transistor and a second terminal of the first transistor; a capacitor coupled between the third transistor and the second terminal of the first transistor; a fourth transistor connected between the second terminal of the first transistor and a second power supply; and a fifth transistor connected between the second terminal of the third transistor and a signal line, wherein the capacitor is the only capacitor in the pixel and wherein the signal line is to receive an initialization voltage and a gray scale data voltage.

A voltage of the first power supply and a voltage of the second power supply may be supplied via a same power line. A gate electrode of the third transistor and a gate electrode of the fourth transistor may be connected to a same control line. A gate electrode of the second transistor and a gate electrode of the fifth transistor may be connected to a same control line. The capacitor may be coupled to an initialization during a first period and a data voltage in a second period after the first period.

BRIEF DESCRIPTION OF THE DRAWINGS

Features will become apparent to those of skill in the art by describing in detail exemplary embodiments with reference to the attached drawings in which:

FIG. 20 illustrates display modes according to another embodiment; and

DETAILED DESCRIPTION

Figure 1:
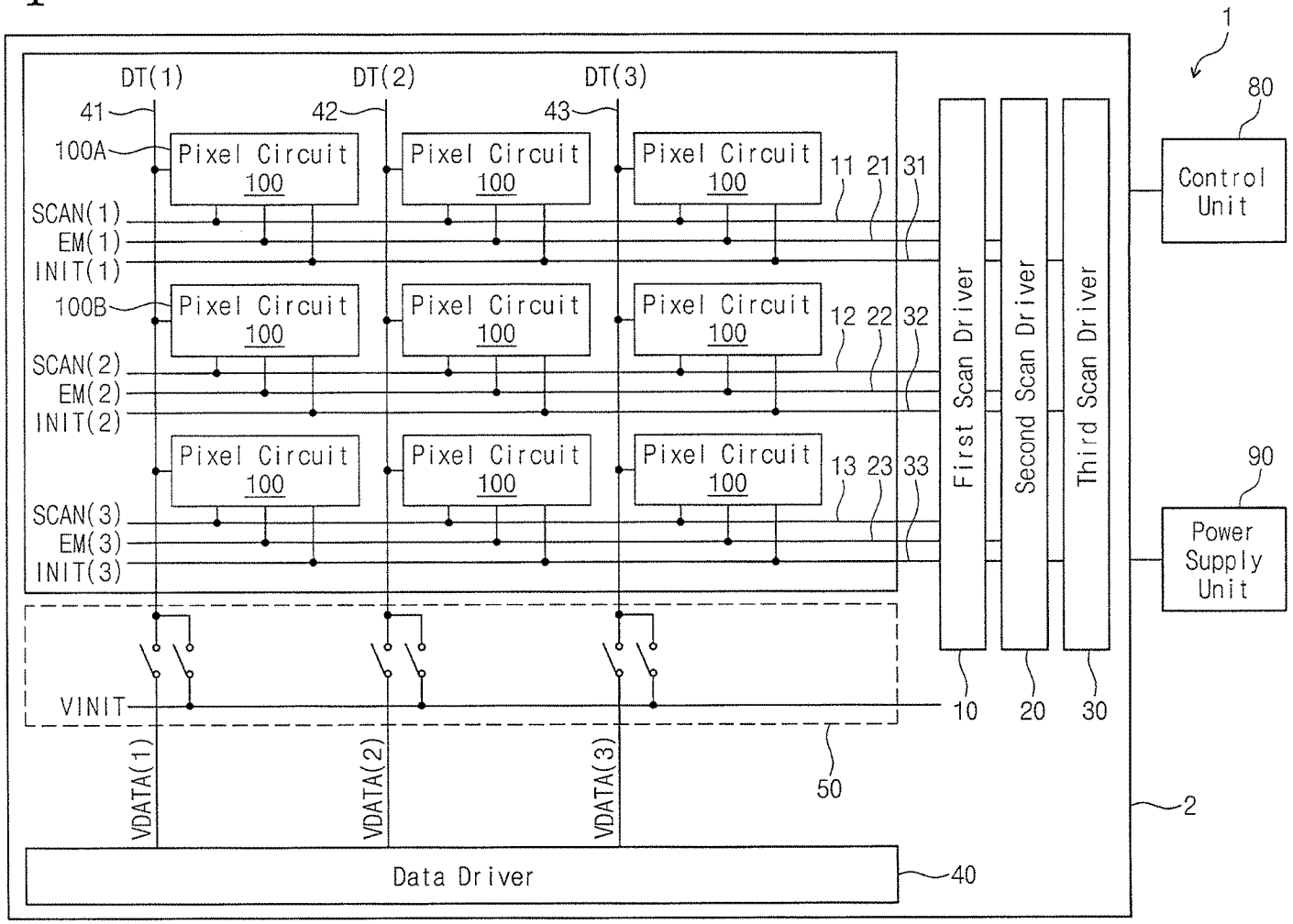
FIG. 1 illustrates an embodiment of a display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an electronic device 1 which includes a light-emitting display apparatus 2, a control unit 80, and a power supply unit 90. The electronic device 1 may be, for example, any one of a variety of portable or stationary electronic devices, including but not limited to a smart phone, a portable telephone, a personal computer, a television, and so on.

Referring to FIG. 1, one embodiment of the light-emitting display apparatus 2 includes a plurality of pixel circuits 100 arranged in a matrix. The light-emitting display apparatus 2 may be a display unit that outputs images through light-emitting elements in the pixel circuits 100. A light-emitting element of each pixel circuit 100 may include a light-emitting diode (e.g., refer to FIG. 2). In one embodiment, a light-emitting diode may be a light-emitting element using an organic light-emitting diode (OLED). The light-emitting diode may be, for example, a light-emitting element (light-emitting diode) with a rectification characteristic.

The control unit 80 may include a central processing unit (CPU) and a memory, and may control operation of the light-emitting display apparatus 2. The control unit 80 controls a first scan driver 10, a second scan driver 20, a third scan driver 30, a data driver 40, and a switch circuit 50. Also, the control unit 80 controls the light-emitting display apparatus 2 based on a predetermined driving scheme, e.g., progressive driving and simultaneous driving.

The power supply unit 90 provides power to the light-emitting display apparatus 2 and the control unit 80. In each pixel circuit 100, a current that flows toward a cathode to an anode of a light-emitting diode may be supplied from the power supply unit 90. For example, the power supply unit 90 may provide each pixel circuit 100 with an anode voltage ELVDD and a cathode voltage ELVSS.

The pixel circuits 100 of the light-emitting display apparatus 2 may be arranged in a matrix with m rows and n rows (an m-by-n matrix), where n and m integers greater than 0. In FIG. 1, the pixels circuits 100 are arranged in three rows and three columns for illustrative purposes only.

Each pixel circuit 100 is controlled by the first scan driver 10, the second scan driver 20, the third scan driver 30, the data driver 40, and the switch circuit 50. The first to third scan drivers 10 to 30 may constitute a driver circuit that selects a row where initialization, threshold voltage (VTH) compensation, data program, and light-emitting operations are to be carried out. The first scan driver 10 provides gate control signals SCAN(n) to gate control signal lines 11 to 13 that correspond to rows of pixel circuits 100, respectively. The second scan driver 20 provides gate control signals EM(n) to gate control signal lines 21 to 23 that correspond to rows of pixel circuits 100. The third scan driver 30 provides gate control signals INIT(n) to gate control signal lines 31 to 33 that correspond to rows of pixel circuits 100.

Figure 2:
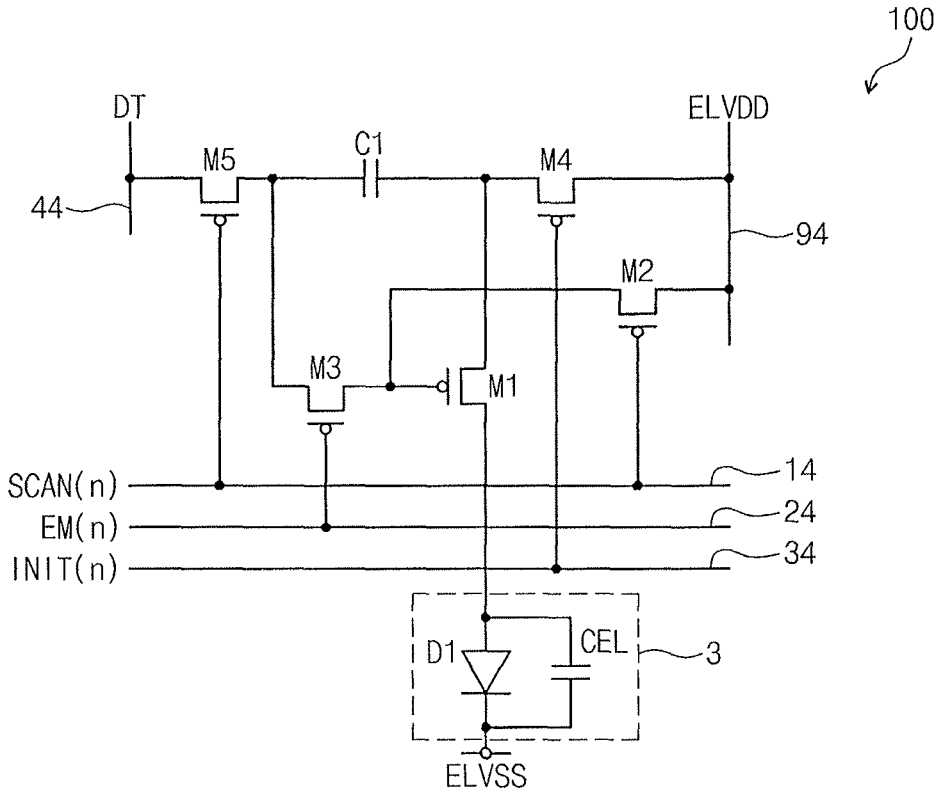
FIG. 2 illustrates an embodiment of a unit pixel.

In one embodiment, the gate control signal SCAN(n) may control a transistor M2 and a transistor M5 (e.g., refer to FIG. 2). The gate control signal EM(n) may control a transistor M3 (e.g., refer to FIG. 2) connected between a gate terminal of a driving transistor and a capacitive element. The gate control signal INIT(n) may control a transistor M4 (e.g., refer to FIG. 2) connected between one of a source and a drain of the driving transistor and the anode voltage ELVDD.

The data driver 40 provides gray scale data voltages VDATA(n) to pixel circuits 100 through respective data lines 41 to 43 that correspond to columns of pixel circuits 100. The gray scale data voltage and the initialization voltage may be selectively provided to pixel circuits 100 via the switch circuit 50 according to each period of circuit operation. The switch circuit 50 is disposed between the data driver 40 and an area where the pixel circuits 100 are disposed.

FIG. 2 illustrates an embodiment of a unit pixel circuit 100 which includes a driving transistor M1, transistors M2 to M5, a capacitive element C1, and a light-emitting element 3. In this embodiment, the pixel circuit 100 therefore has five transistors M1 to M5, one capacitive element C1, and the light-emitting element 3. The light-emitting element 3 is formed of a light-emitting diode D1 and a parasitic capacitance CEL. In FIG. 2, the transistors M1 to M5 are formed of p-channel transistors.

Referring to FIG. 2, a cathode terminal of the light-emitting element 3 is connected to a cathode voltage ELVSS. A first terminal of the driving transistor M1 is connected to an anode terminal of the light-emitting element 3. The driving transistor M1 may adjust the magnitude of current, supplied to the light-emitting element 3, based on a voltage supplied to the gate electrode of the driving transistor M1.

The transistor M2 is connected between the gate electrode of the driving transistor M1 and an anode voltage line 94. The transistor M2 is controlled by a gate control signal SCAN(n). A first terminal of the transistor M3 is controlled by a gate control signal EM(n) and is connected to the gate electrode of the driving transistor M1.

A second terminal of the transistor M3 is connected to a second terminal of the driving transistor M1 via the capacitive element C1. The transistor M4 is connected between the second terminal of the driving transistor M1 and the anode voltage line 94. The transistor M4 is controlled by a gate control signal INIT(n). The transistor M5 is controlled by the gate control signal SCAN(n) and is connected between the second terminal of the transistor M3 and a data line 44.

Because all transistors of a pixel circuit are formed of a p-channel transistor, a transistor is turned on when a control signal of a low level is applied to its gate electrode. At this time, the transistor may be in a conduction state. Conversely, a transistor is turned off when a control signal of a high level is applied to its gate electrode. At this time, the transistor may be in a non-conduction state.

Figure 3A:
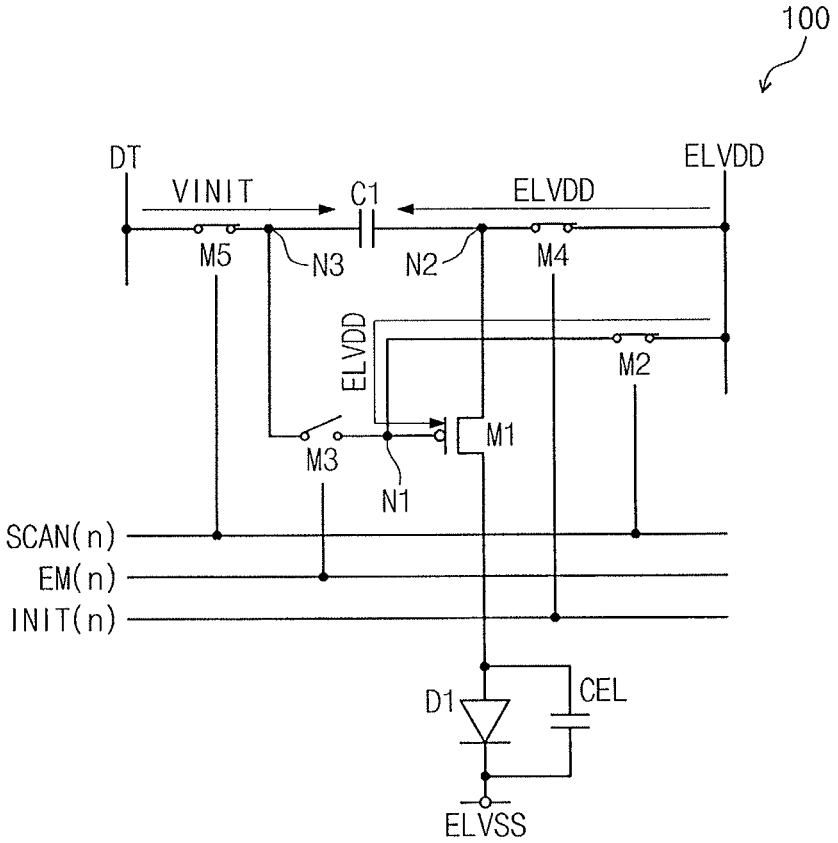
FIGS. 3A to 3C illustrate operational states of a unit pixel.
Figure 3B:
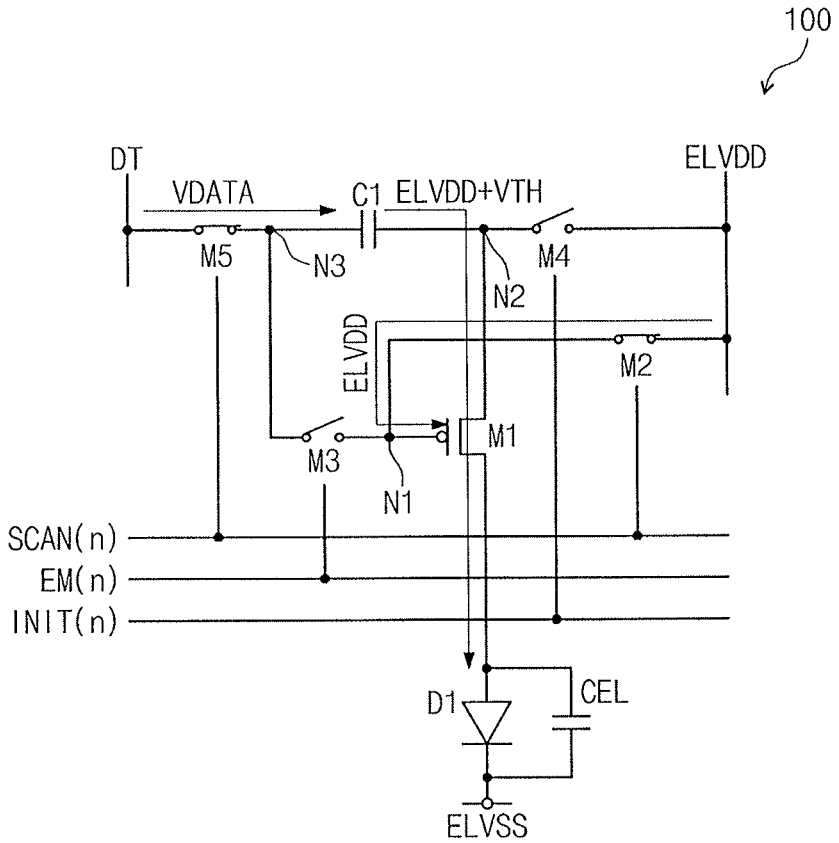
Figure 3C:
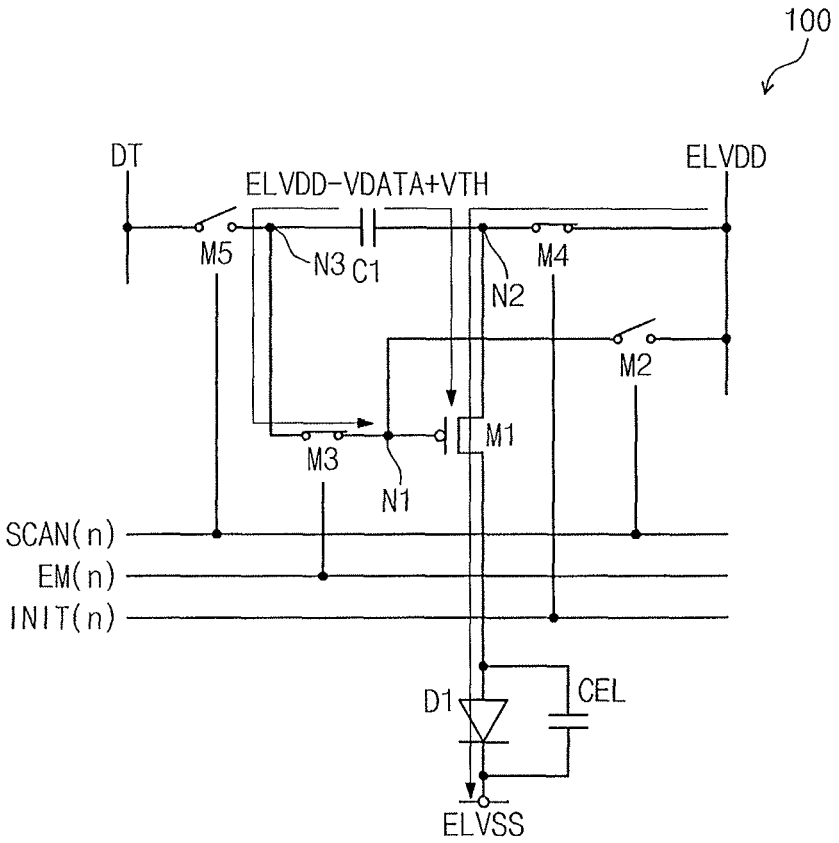
Figure 4:
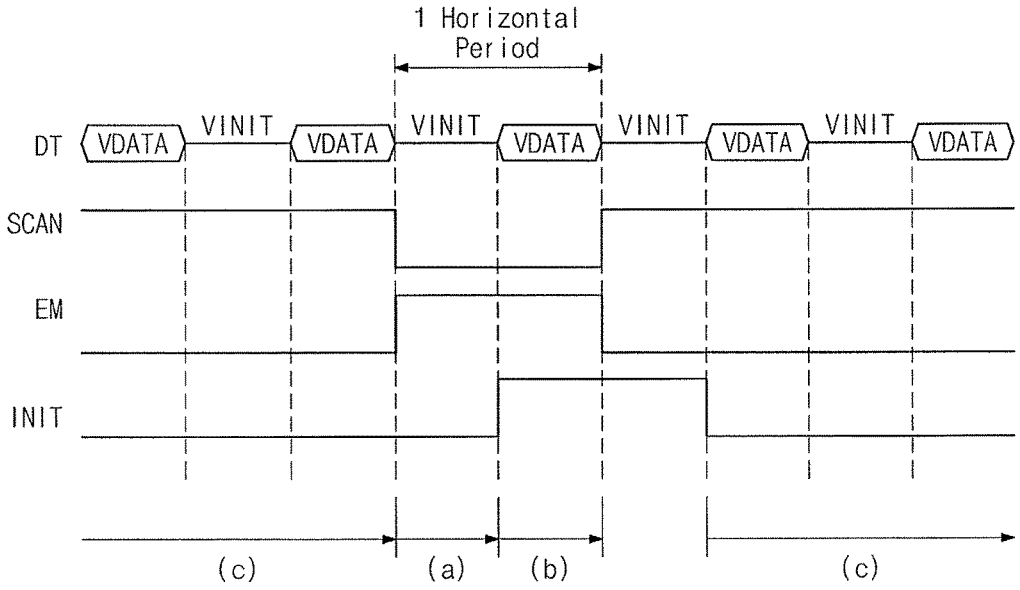
FIG. 4 illustrates an embodiment of a timing diagram for a unit pixel.

FIGS. 3A to 3C illustrate operational states of a unit pixel such as illustrated in FIG. 2, and FIG. 4 illustrates an example of a timing diagram for driving this unit pixel. Collectively, FIGS. 3A to 3C and FIG. 4 may correspond to an embodiment of a method for driving the unit pixel.

Referring to FIGS. 3A to 3C, this method includes an initialization period (a), a VTH compensation and data program period (b), and a light-emitting period (c). The periods (a), (b), and (c) in FIGS. 3A to 3C may correspond to an initialization period (a), a VTH compensation and data program period (b), and a light-emitting period (c) in FIG. 4. In FIGS. 3A to 3C, arrows represents current directions.

Initialization Period

During the initialization period (a), a data signal DT having an initialization voltage VINIT is applied to pixel circuit 100. The transistor M3 is turned off in response to a gate control signal EM of a high level, and the transistors M2, M4, and M5 are turned on in response to a gate control signal SCAN of a low level and a gate control signal INIT of a low level. In FIG. 4, the gate control signal INIT may have a low level from a period before the initialization period (a).

An anode voltage ELVDD is applied to a gate electrode (node N1) of the driving transistor M1, via the transistor M2, to turn off the driving transistor M1.

A terminal (node N2) of the capacitive element C1 adjacent to the transistor M4 is supplied with the anode voltage ELVDD via the transistor M4. The initialization voltage VINIT is applied via the transistor M5 to a terminal (node N3) of the capacitive element C1 adjacent to the transistor M5. Thus, the capacitive element C1 is initialized by charging the capacitive element C1 with a voltage corresponding to a difference between the anode voltage ELVDD and the initialization voltage VINIT, e.g., the initialization voltage is charged in the capacitive element C1. At this time, the driving transistor M1 is turned off, because a potential difference VGS between a source and a gate of the driving transistor M1 is substantially zero.

VTH Compensation and Data Program Period

During the VTH compensation and data program period (b), a voltage of the data signal DT is switched from the initialization VINIT to a gray scale data voltage VDATA by a switch circuit 50. Because the gate control signal SCAN maintains a low level, the gray scale data voltage VDATA is provided to the node N3. The transistor M4 is turned off because the gate control signal INIT has a high level. At this time, the node N2 is in a floating state.

A voltage at the node N3 is switched from the initialization (low voltage) VINIT to the gray scale data voltage (high voltage) VDATA. As a potential at the node N3 increases, a potential at the node N2 that is capacitively coupled via the capacitive element C1 also increases.

Although the anode voltage ELVDD is supplied to the gate electrode of the driving transistor M1, the driving transistor M1 is turned on if a gate-source voltage VGS of the driving transistor M1 exceeds an inherent threshold voltage VTH of the driving transistor M1, according to an increase in a voltage at the node N2.

Charge stored in the capacitive element C1 flows into a cathode voltage ELVSS via the driving transistor M1. The driving transistor M1 is stably turned off when a potential at the node N2 corresponds to a sum of the anode voltage ELVDD and a threshold voltage VTH (ELVDD+VTH). At this time, the capacitive element C1 is charged with a voltage corresponding to a difference between (ELVDD+VTH) and the gray scale data voltage VDATA. This state may be a state where the capacitive element C1 is charged with a voltage determined according to the gray scale data voltage and the threshold voltage.

At this time, charge stored in the capacitive element C1 may flow into the light-emitting element 3 via the driving transistor M1. However, considering a capacitance of the capacitive element C1, the amount of current flowing into a diode element D1 of the light-emitting element 3 may be very small, so light-emitting does not occur.

The transistors M2 and M5 may be turned off because the gate control signal SCAN transitions to a high level at an end of the VTH compensation and data program period (b). Also, as the gate control signal EM transitions to a low level, the transistor M3 may be turned on.

Thus, the nodes N1 and N3 have the gray scale data voltage VDATA because of charge stored in the capacitive element C1, and the node N2 maintains (ELVDD+VTH). The nodes N1 to N3 may be at a floating state during a transitional period between the VTH compensation and data program period (b) and a light-emitting period (c). At this time, a potential difference VGS between the gate and source of the driving transistor VTH may correspond to a voltage determined according to a gray scale data voltage, written at the capacitive element C1, and a threshold voltage.

Light-Emitting Period

During the light-emitting period (c), the anode voltage ELVDD is provided to the node N2 when the transistor M4 is turned on in response to the gate control signal NIT of a low level. As (ELVDD+VTH) at the node N2 changes into the anode voltage ELVDD, a gray scale data voltage VDATA at the node N3 changes into (VDATA+−VTH). However, no voltage stored in the capacitive element C1 may vary.

A current is supplied to the light-emitting element 3 via the driving transistor M1. The current corresponds to a voltage determined according to a gray scale data voltage charged in the capacitive element C1 and a threshold voltage, from among a current supplied from the anode voltage ELVDD. For example, the current may correspond to a VTH-compensated gray scale data voltage. Thus, the light-emitting element 3 emits light.

Figure 5:
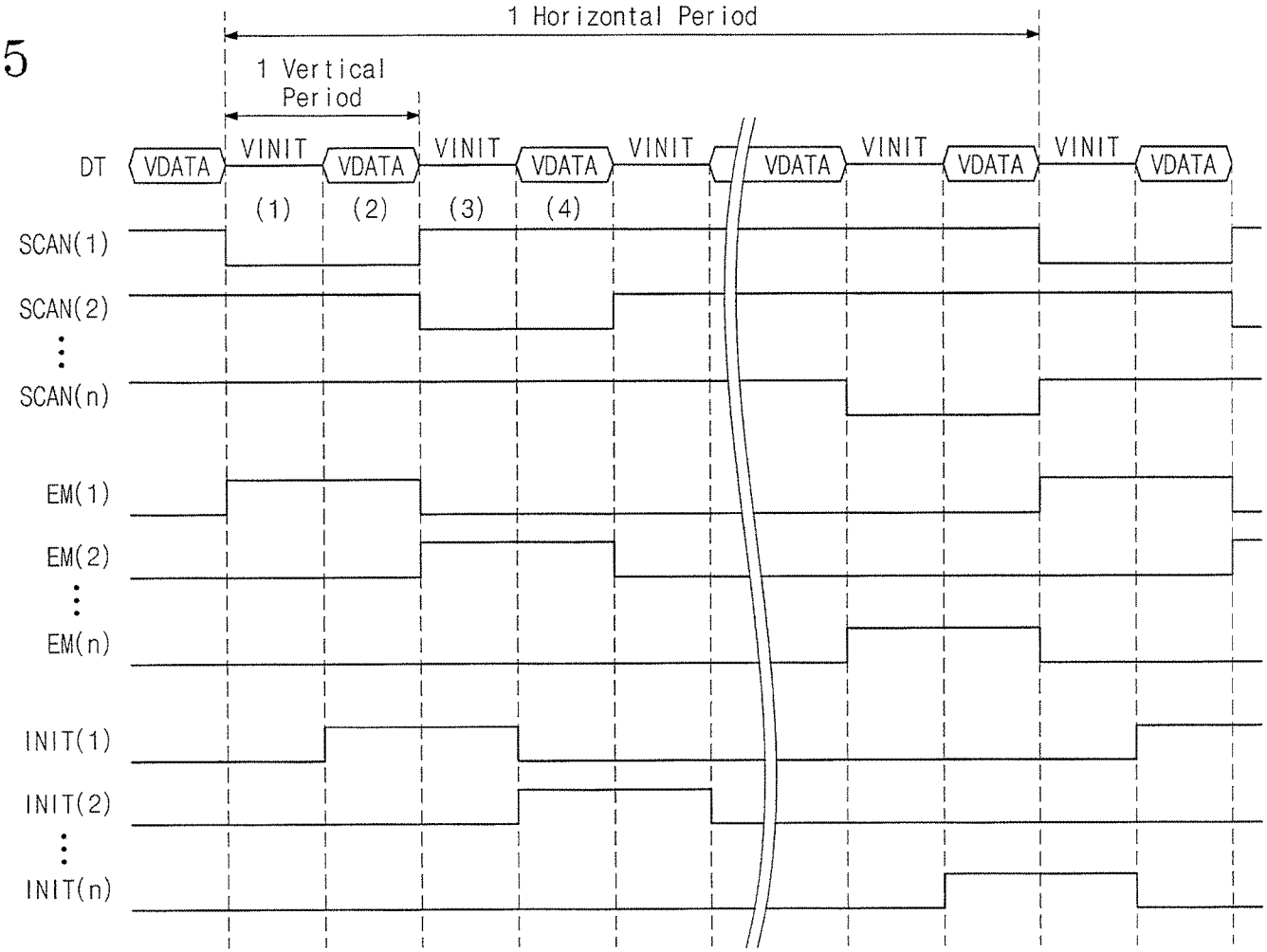
FIG. 5 illustrates an embodiment of a timing diagram for a display apparatus.
Figure 6:
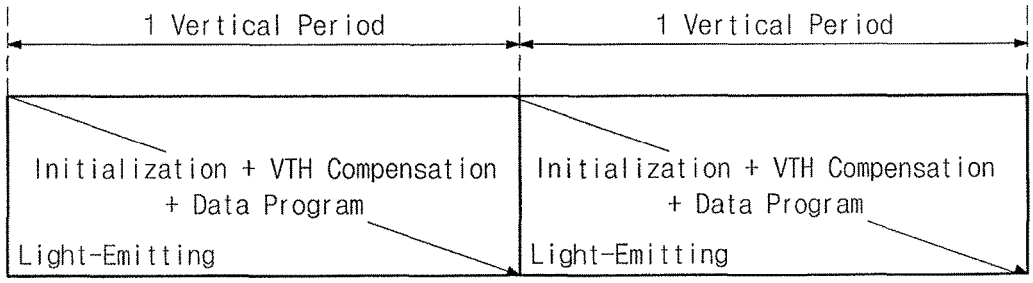
FIG. 6 illustrates an embodiment of a method for driving a display apparatus.

FIG. 5 illustrates another embodiment of a timing diagram for a light-emitting display apparatus, and FIG. 6 illustrates an embodiment of a method for driving the light-emitting display apparatus. These embodiments will be described relative to operation of a plurality of pixel circuits 100 with reference to FIGS. 1 to 5. For example, operation of a pixel circuit 100A at the first row and first column and a pixel circuit 100B at the second row and first column will be described with reference to a timing diagram of a light-emitting display apparatus in FIG. 5.

Referring to FIGS. 1 and 5, during a period (1), an initialization voltage VINIT is provided to the pixel circuit 100A as a data signal DT. The pixel circuit 100A is initialized when gate control signals SCAN(1) and INIT(1) transition to a low level. At this time, a state of the pixel circuit 100A may correspond to an initialization period (a).

During a period (2) of FIG. 5, a gray scale data voltage VDATA is provided to the pixel circuit 100A as the data signal DT, and a gate control signal INIT(1) has a high level. Thus, a capacitive element C1 is charged with a voltage determined based on a gray scale data voltage and a threshold voltage. At this time, a state of the pixel circuit 100A may correspond to a VTH compensation and data program period (b).

During a period (3) of FIG. 5, an initialization voltage VINIT is supplied to a pixel circuit 100B as a data signal DT, and gate control signals SCAN(2) and INIT(2) have a low level. Thus, the pixel circuit 100B is initialized. At this time, a state of the pixel circuit 100B may correspond to an initialization period (a).

Meanwhile, a state of the pixel circuit 100A may correspond to a transitional period between the VTH compensation and data program period (b) and the light-emitting period (c). Nodes N1 to N3 may be in a floating state during the transitional period, where the gate control signal SCAN (1) has a high level and the gate control signal EM(1) has a low level.

During a period (4) of FIG. 5, a gray scale data voltage VDATA is provided to the pixel circuit 100A as a data signal DT, and the gate control signal INIT(1) has a low level. Thus, a driving transistor M1 of the pixel circuit 100A provides a light-emitting element 3 with current corresponding to a voltage charged in the capacitive element C1. At this time, a state of pixel circuit 100A may correspond to light-emitting period (c).

Also, because a gate control signal INIT(2) has a high level in the same period, a capacitive element C1 of the pixel circuit 100B is charged with a voltage determined according to a gray scale data voltage and a threshold voltage. At this time, a state of the pixel circuit 100B may correspond to the VTH compensation and data program period (b).

The above-described operations are repeated with respect to pixel circuits, so a light-emitting state and a non-light-emitting state including a line-sequential initialization operation and a VTH compensation and data program operation are iterated in turn. Thus, as illustrated in FIG. 6, a light-emitting display apparatus 2 may operate in a progressive driving manner.

Figure 7:
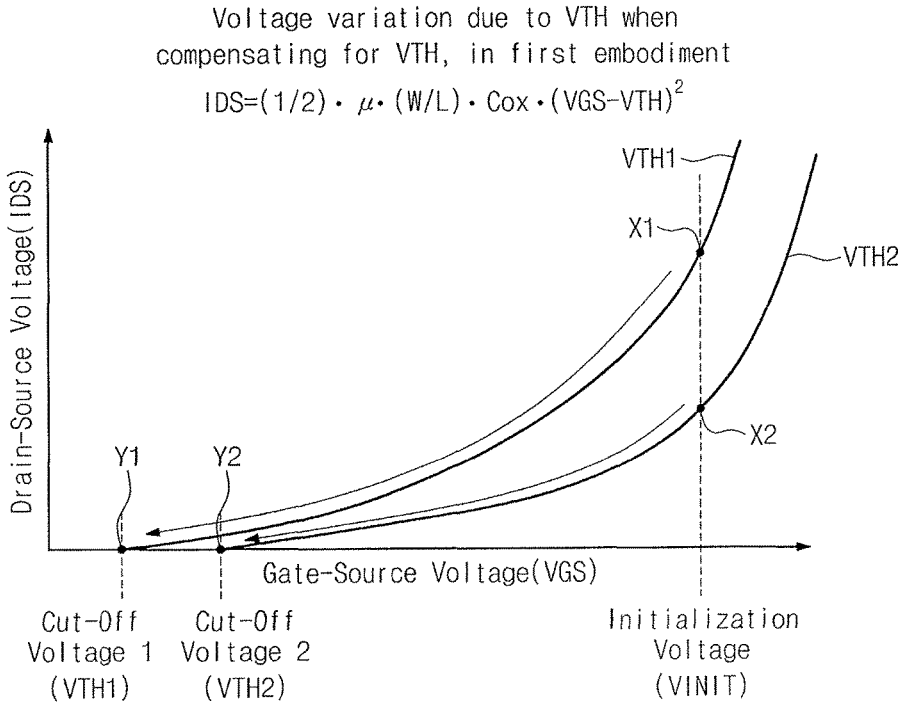
FIG. 7 illustrates an example of variation in gate-source voltages.

FIG. 7 illustrates an example of a variation in gate-source voltage for two threshold voltages when compensating for a threshold voltage. In FIG. 7, a variation in gate-source voltages of driving transistors having different threshold voltages VTH1 and VTH2 is illustrated. Also, IDS represents a source-drain current of a driving transistor, and VGS represents a gate-voltage voltage of a driving transistor.

Also, a source of a driving transistor M1 is located adjacent to an anode voltage ELVDD, and a drain thereof is located adjacent to a cathode voltage ELVSS.

Referring to FIG. 7, the driving transistor M1 has a threshold voltage VTH1 as a threshold voltage characteristic for a cut-off voltage Y1, and has a threshold voltage VTH2 as a threshold voltage characteristic for a cut-off voltage Y2.

When an initialization voltage VINIT is provided to the two driving transistors M1 as VGS of each of two driving transistors M1, the threshold voltage VHT1 characteristic goes to an X1 state and the threshold voltage VTH2 characteristic goes to an X2 state. Although the same gate voltage is applied to the two driving transistors M1, their current values may be different from each other according to a variation in threshold voltages VTH1 and VTH2.

Next, if a supply of the initialization voltage VINIT is blocked, a drain-source current IDS corresponding to VGS may flow according to the threshold voltages characteristics VTH1 and VTH2. When gate-source voltages VGS of the two driving transistor M1 decrease and reach the cut-off voltages Y1 and Y2, the two driving transistors M1 are turned off. The driving transistors M1 may be cut off at the same drain-source current IDS.

In one embodiment, an anode voltage ELVDD may be provided to a gate electrode of each driving transistor M1 in a VTH compensation and data program period (b) on two pixel circuits, including driving transistors M1 having the threshold voltage characteristics VTH1 and VTH2. A source voltage of a pixel circuit including a driving transistor with the threshold voltage characteristic VTH1 may be (ELVDD+VTH1). A source voltage of a pixel circuit including a driving transistor with the threshold voltage characteristic VTH2 may be (ELVDD+VTH2).

Driving transistors with the threshold voltages characteristics VTH1 and VTH2 are cut off at the same current value. Thus, variation in threshold voltages of driving transistors with different threshold voltages may be corrected. Thus, according to the present embodiment, a variation in threshold voltages of driving transistors with different threshold voltages may be adjusted, and a gray scale of a pixel circuit may be adjusted to a gray scale data voltage VDATA more exactly.

In one embodiment, the initialization, VTH compensation and data program, and light-emitting may be controlled using five transistors M1 to M5 and one capacitive element C1. Because the number of capacitive elements is reduced, high resolution may be achieved. In an alternative embodiment, an anode voltage ELVDD is provided to nodes N1 and N2 in an initialization period (a). However, different voltages sufficient to turn off a driving transistor M1 may be provided to the nodes N1 and N2.

Figure 8:
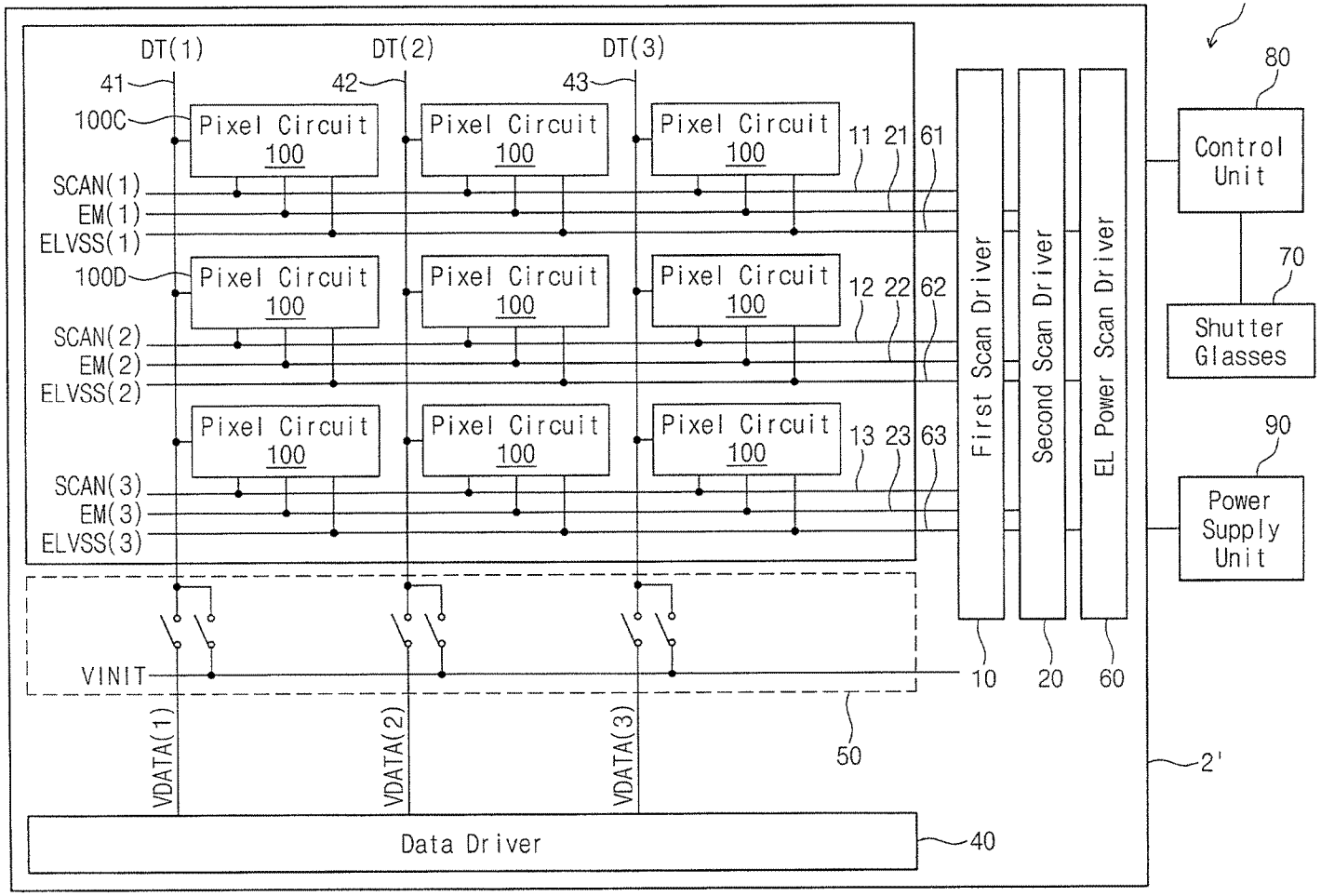
FIG. 8 illustrates another embodiment of a display apparatus.

FIG. 8 illustrates another embodiment of an electronic device 1' including a light-emitting display apparatus 2'. The light-emitting display apparatus 2' includes an EL power scan driver 60 instead of the third scan driver 30 in the embodiment of FIG. 1. The EL power scan driver 60 may be a driving circuit that controls a cathode voltage of each pixel circuit 100. The EL power scan driver 60 supplies an EL voltage ELVSS(n) to EL power lines 61 to 63 that correspond to rows of pixel circuits 100, respectively.

Figure 9:
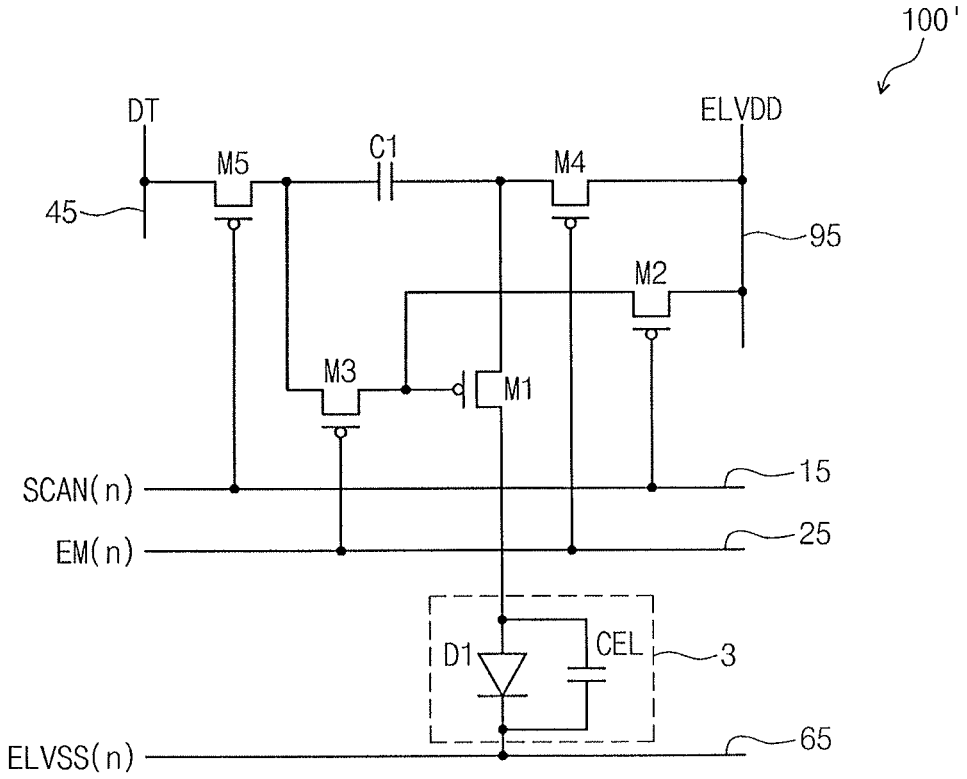
FIG. 9 illustrates another embodiment of a unit pixel.
Figure 10A:
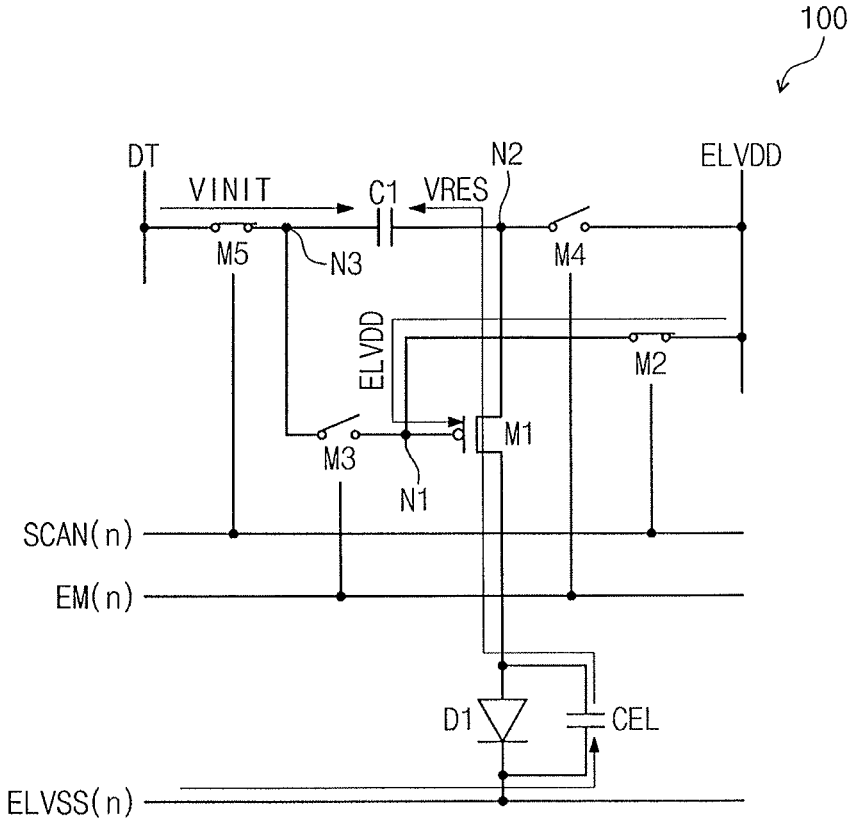
FIGS. 10A to 10D illustrate operational states of a unit pixel.
Figure 10B:
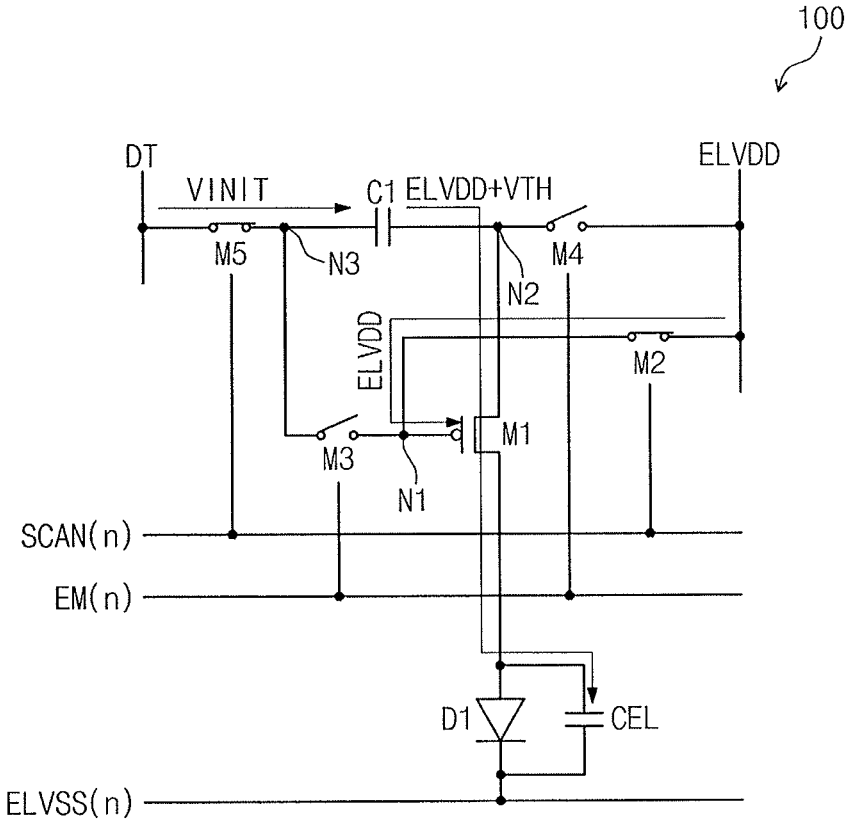
Figure 10C:
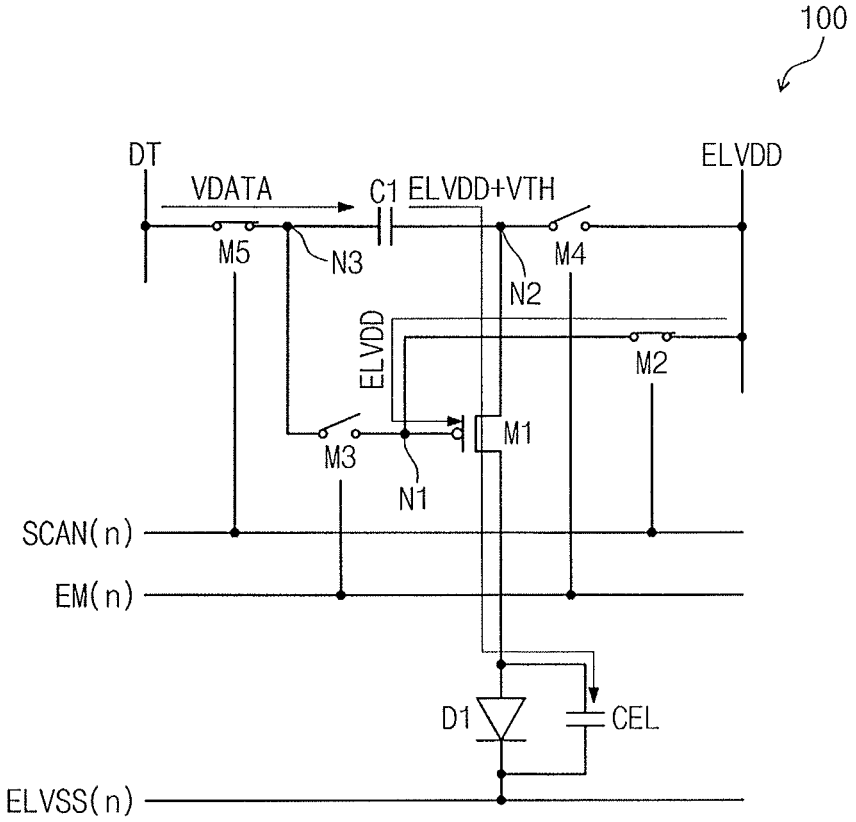
Figure 10D:
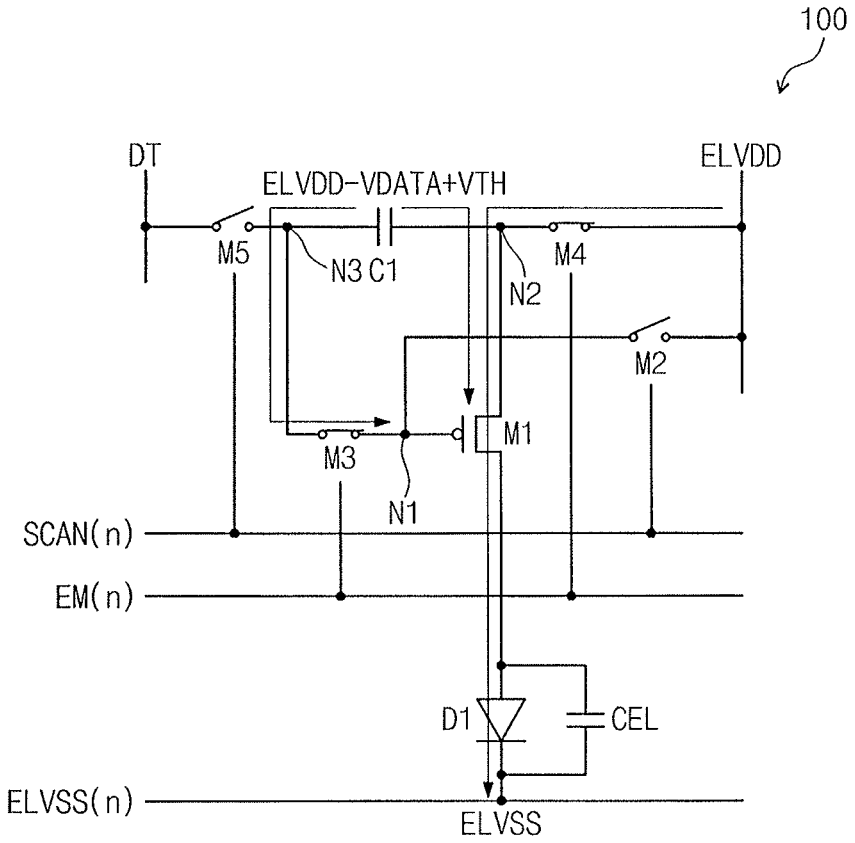

FIG. 9 illustrates another embodiment of a unit pixel 100' including transistors M3 and M4 which are simultaneously controlled by a gate control signal EM(n). An EL power line 65 is connected to a cathode-side terminal of a light-emitting element 3. The EL power line 65 is provided with a high voltage or a low voltage from an EL power scan driver 60.

Figure 11:
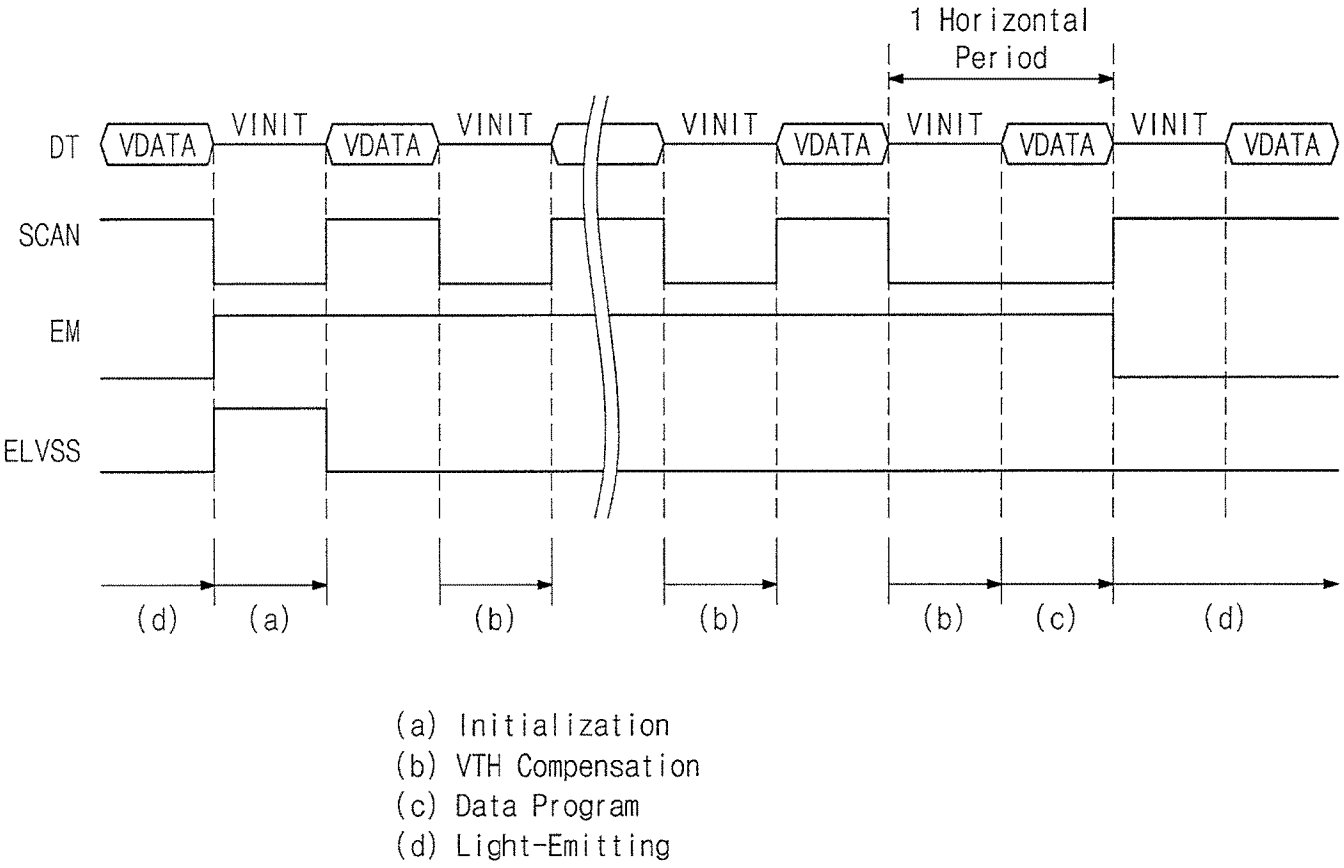
FIG. 11 illustrates an embodiment of a timing diagram for a unit pixel.

FIGS. 10A to 10D illustrate an embodiment of operational states of the unit pixel 100', and FIG. 11 is an example of a timing diagram for the unit pixel 100'. Collectively, these embodiments for another method for driving a unit pixel.

Referring to FIGS. 10A to 10D, the method includes operations performed during an initialization period (a), a VTH compensation period (b), a data program period (c), and a light-emitting period (d).

Initialization Period

During the initialization period (a), a data signal DT corresponding to an initialization voltage VINIT is applied to the pixel circuit 100'. Transistors M2 and M5 are turned on in response to a gate control signal SCAN of a low level, and transistors M3 and M4 are turned off in response to a gate control signal EM of a high level.

An anode voltage ELVDD is provided to a node N1 via the transistor M2, and an initialization voltage VINIT is provided to a node N3 via the transistor M5. Because the EL voltage ELVSS has a high level VRES, a potential at an anode-side terminal of the light-emitting element 3 capacitively coupled via a parasitic capacitance CEL of the light-emitting element 3 increases until the driving transistor M1 is turned on. A potential at the node N2 also increases via the turned-on driving transistor M1. With the above-described operation, the capacitive element C1 is charged based on the initialization voltage VINIT and a voltage determined by the high-level voltage VRES, e.g., a difference between the initialization voltage VINIT and the high-level voltage VRES.

The EL voltage ELVSS may vary such that a voltage of the anode-side terminal of the light-emitting element 3 is higher than (ELVDD+VTH). In the present embodiment, the threshold voltage VTH may be made up for (e.g., compensated) at an initialization point in time, as described below.

VTH Compensation Period

During the VTH compensation period (b), the data signal DT corresponding to the initialization voltage VINIT is applied to the pixel circuit 100'. The transistors M2 and M5 are turned on in response to the gate control signal SCAN of a low level, and the transistors M3 and M4 are turned off in response to the gate control signal EM of a high level.

Because an EL voltage ELVSS has a low level, a potential at the anode-side terminal of the light-emitting element 3 capacitively coupled via the parasitic capacitance CEL of the light-emitting element 3 decreases. A source-drain potential of the driving transistor M1 is opposite to that corresponding to the initialization period. Thus, charge stored in the capacitive element C1 moves into the light-emitting element 3 via the driving transistor M1.

A potential at the node N2 decreases due to a charge transfer. The decrease in potential may correspond to (ELVDD+VTH). At this time, the driving transistor M1 is turned off and stabilized. For example, the capacitive element C1 is charged with a voltage determined according to a threshold voltage.

A portion of the charge transferred via the driving transistor M1 flows through a diode element D1 of the light-emitting element 3. However, considering a capacitance of the capacitive element C1, the amount of current flowing into the diode element D1 of the light-emitting element 3 may be very small, so light-emitting does not occur.

Because threshold voltage compensation may be performed multiple times between the initialization period (a)

and the light-emitting period (d) as illustrated in FIG. 11, the threshold voltage is made up for (e.g., compensated) more exactly.

Data Program Period

During the data program period (c), a voltage of the data signal DT is switched from the initialization VINIT to a gray scale data voltage VDATA via a switch circuit 50. Because the gate control signal SCAN maintains a low level and the gate control signal EM maintains a high level, the gray scale data voltage VDATA is provided to the node N3.

A voltage at the node N3 is switched from the initialization (low voltage) VINIT to the gray scale data voltage (high voltage) VDATA. As a potential at the node N3 increases, a potential at the node N2, that is capacitively coupled via the capacitive element C1, also increases. The anode voltage ELVDD is supplied to a gate electrode of the driving transistor M1. However, the driving transistor M1 is turned on if a drain-source voltage VGS of the driving transistor M1 exceeds an inherent threshold voltage VTH of the driving transistor M1, according to an increase in a voltage at the node N2.

Charge stored in the capacitive element C1 flows into the light-emitting element 3 via the driving transistor M1. The driving transistor M1 is stably turned off when a potential at the node N2 corresponds to a sum of the anode voltage ELVDD and a threshold voltage VTH (ELVDD+VTH). At this time, the capacitive element C1 is charged with a voltage corresponding to a difference between (ELVDD+VTH) and the gray scale data voltage VDATA. This state may be defined as a state where the capacitive element C1 is charged with a voltage determined according to the gray scale data voltage and the threshold voltage.

At this time, charge stored in the capacitive element C1 may flow into the light-emitting element 3 via the driving transistor M1. However, considering a capacitance of the capacitive element C1, the amount of current flowing into a diode element D1 of the light-emitting element 3 may be very small, so light-emitting does not arise.

Light-Emitting Period

During the light-emitting period (d), the transistors M2 and M5 are turned off in response to the gate control signal SCAN of a high level, and the transistors M3 and M4 are turned on in response to the gate control signal EM of a low level. In this case, the anode voltage ELVDD is provided to the node N2.

Similar to the previous embodiment, a current is supplied to the light-emitting element 3 via the driving transistor M1. The current corresponds to a voltage determined according to a gray scale data voltage charged in the capacitive element C1 and a threshold voltage, from among a current supplied from the anode voltage ELVDD, e.g., a current corresponding to VTH-compensated gray scale data voltage. Thus, the light-emitting element 3 emits light.

Figure 12:
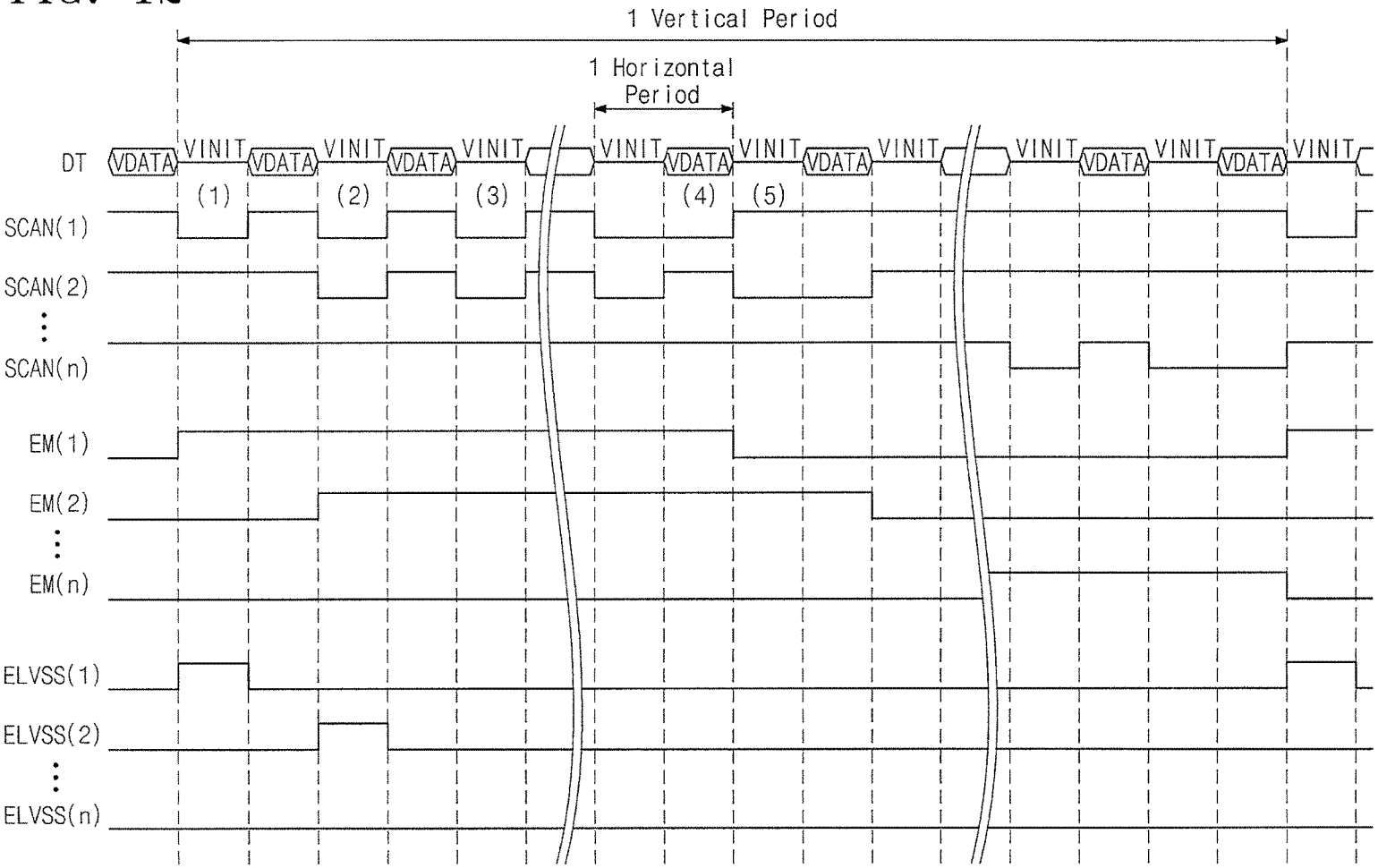
FIG. 12 illustrates an embodiment of a timing diagram for display apparatus.

FIG. 12 illustrates another timing diagram of a light-emitting display apparatus. This embodiment will be explained for operation of a plurality of pixel circuits with reference to FIGS. 8 to 12. For example, operation of a pixel circuit 100C at the first row and first column and a pixel circuit 100D at the second row and first column in pixel circuits in FIG. 8 will be described with reference to the timing diagram.

Referring to FIGS. 8 and 12, during a period (1), an initialization voltage VINIT is provided to the pixel circuit 100C as a data control signal DT. The pixel circuit 100D is initialized when a gate control signal SCAN(1) has a low level, a gate control signal EM(1) has a high level, and an EL voltage ELVSS(1) has a high level. At this time, the pixel circuit 100C may correspond to an initialization period (a).

During a period (2), the initialization voltage VINIT is provided to the pixel circuit 100C as a data control signal DT. Threshold voltage compensation on the pixel circuit 100C is performed when gate control signals SCAN(1) and SCAN(2) and the EL voltage ELVSS(1) have a low level and gate control signals EM(1) and Em(2) have a high level. At this time, the pixel circuit 100C may correspond to a threshold voltage compensation period (b), and the pixel circuit 100D may correspond to the initialization period (a).

During a period (3), pixel circuits in the third row may be initialized, and threshold voltage compensation on the pixel circuits 100C and 100D may be performed. At this time, the pixel circuits 100C and 100D may correspond to the threshold voltage compensation period (b). Afterwards, while pixel circuits in a next row (e.g., fourth row) are sequentially initialized, threshold voltage compensation on the pixel circuits 100C and 100D may be performed multiple times. Thus, it is possible to make up for (e.g., compensate) a threshold voltage more exactly.

During a period (4), a gray scale data voltage VDATA is provided to the pixel circuit 100C as a data control signal DT. Because the gate control signal SCAN(1) maintains a low level, the capacitive element C1 is charged with a voltage determined according to a gray scale data voltage and a threshold voltage. At this time, the pixel circuit 100C may correspond to a data program period (c).

During a period (5), a current corresponding to a voltage charged in the capacitive element C1 is supplied to the light-emitting element 3 via the driving transistor M1 of the pixel circuit 100C, because the gate control signal SCAN(1) has a high level and the gate control signal EM(1) has a low level. At this time, the pixel circuit 100C may correspond to a light-emitting period (d). Also, the pixel circuit 100D may correspond to the threshold voltage compensation period (b).

The above-described operations are repeated with respect to other pixel circuits, so a light-emitting state and a non-light-emitting state including a line-sequential initialization operation and a VTH compensation and data program operation are iterated in turn. Thus, as illustrated in FIG. 12, a light-emitting display apparatus 2 may operate in a progressive driving manner.

In this embodiment, threshold voltage compensation is performed multiple times between the initialization period and the light-emitting period. Thus, the threshold voltage may be adjusted more exactly.

Figure 13:
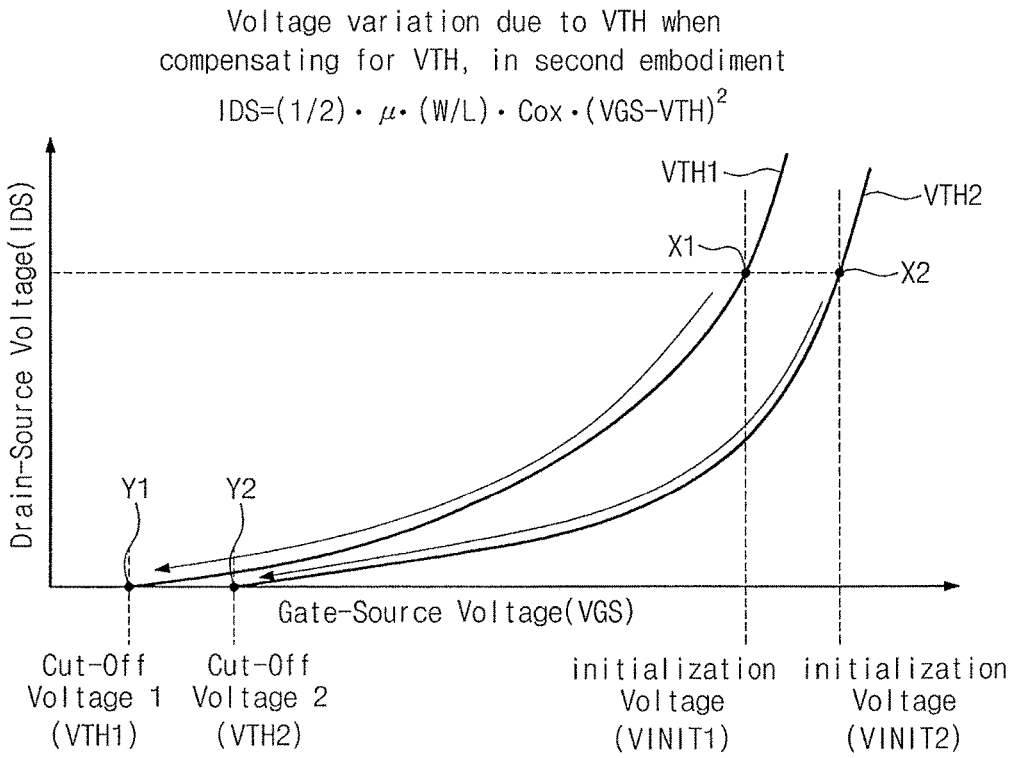
FIG. 13 illustrates an example of variation in a gate-source voltage.

FIG. 13 illustrates another example of a variation in a gate-source voltage for multiple threshold voltages, when performing threshold voltage compensation. In FIG. 13, the variation in gate-source voltages of driving transistors having different threshold voltages VTH1 and VTH2 is illustrated. IDS represents a source-drain current of a driving transistor, and VGS represents a gate-voltage voltage of a driving transistor.

In FIG. 13, a source and a drain are switched in an operation. Also, the gate-source voltage VGS may referred to as a potential difference between a gate of a driving transistor M1 and an ELVDD-side terminal (e.g., terminal connected to a capacitive element C1 and a transistor M4). Also, a threshold voltage characteristic of a driving transistor with a cut-off voltage Y1 is referred to as a threshold voltage VTH1, and a threshold voltage characteristic of a driving transistor with a cut-off voltage Y2 is referred to as a threshold voltage VTH2.

Referring to FIG. 13, the same voltage is supplied to two driving transistors M1 from an EL voltage ELVSS. However, because the EL voltage ELVSS is supplied to pixel circuits via driving transistors, an initialization VINIT1 is supplied to a pixel circuit due to a threshold voltage VTH1 of a driving transistor, and an initialization voltage VINIT2 is supplied to a pixel circuit due to a threshold voltage VTH2 of a driving transistor. Because the amount of current at an X1 state and the amount of current at an X2 state come close to each other, a threshold voltage VTH may be made up for (e.g., compensated).

Next, if a supply of the initialization voltage VINIT is blocked, a drain-source current IDS corresponding to VGS may flow according to the threshold voltages VTH1 and VTH2. When gate-source voltages VGS of the two driving transistor M1 decrease and reach the cut-off voltages Y1 and Y2, the two driving transistors M1 are turned off. The driving transistors M1 may be cut off at the same drain-source current IDS.

In addition to the effect obtained from a pixel circuit according to the previous embodiment, the present embodiment may provide a compensation operation in an initialization period and may perform a plurality of threshold voltage compensation operations, thereby making it possible to compensate for threshold voltage more exactly.

Figure 14:
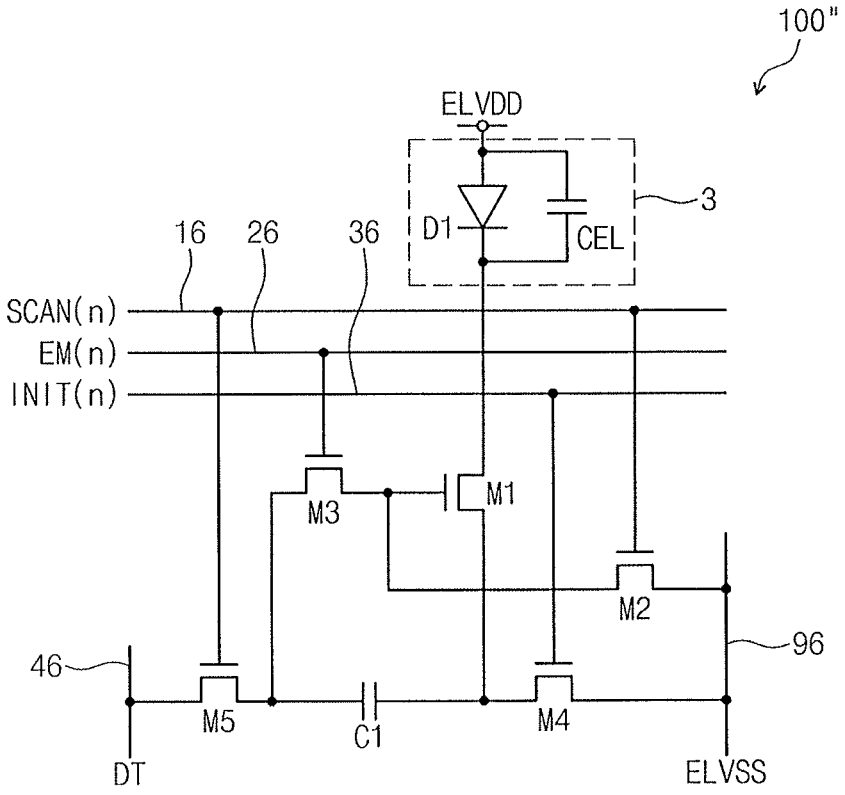
FIG. 14 illustrates another embodiment of a unit pixel.

FIG. 14 illustrates another embodiment of a unit pixel" which includes n-channel transistors. Referring to FIG. 14, an anode-side terminal of a light-emitting element 3 is connected to an anode voltage ELVDD. A first terminal of a driving transistor M1 is connected to a cathode-side terminal of the light-emitting element 3. The driving transistor M1 adjusts the magnitude of current supplied to the light-emitting element 3, based on a voltage supplied to a gate electrode of the driving transistor M1.

A transistor M2 is connected between the gate of the driving transistor M1 and a cathode power line 96. The transistor M2 is controlled by a gate control signal SCAN (n). A transistor M3 is controlled by a gate control signal EM(n), and has a first terminal connected to the gate electrode of the driving transistor M1 and a second terminal connected to a second terminal of the driving transistor M1 via a capacitive element C1.

A transistor M4 is connected between the second terminal of the driving transistor M1 and the cathode power line 96. The transistor M4 is controlled by a gate control signal INIT(n). A transistor M5 is connected between the second terminal of the transistor M3 and a data line 46. The transistor M5 is controlled by the gate control signal SCAN (n).

Figure 15:
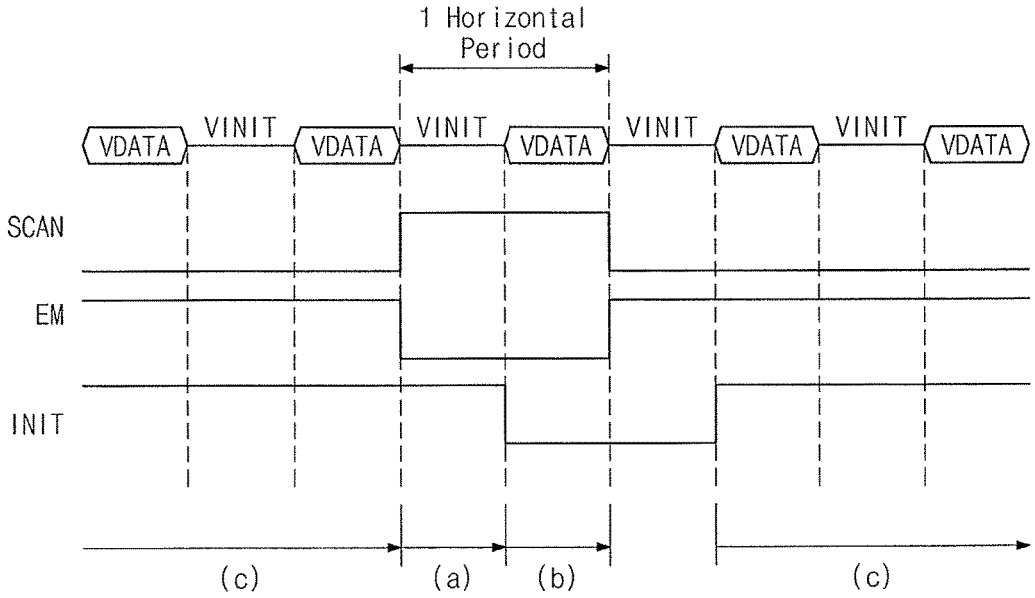
FIG. 15 illustrates an embodiment of a timing diagram for a display apparatus.

FIG. 15 illustrates an example of a timing diagram for controlling the unit pixel 100" in FIG. 14. All transistors M1 to M5 in a pixel circuit 100" are n-type transistors, and therefore are controlled based on different logical levels of control signals SCAN, EM, and INIT compared to p-type transistor embodiments. Also, the timing in FIG. 15 may be substantially the same as in one or more previous embodiments, except the logical levels of the control signals for driving transistors M1 to M5 in a pixel circuit 100" are inverted.

Also, because the mobility of an n-channel transistor is greater than a p-channel transistor, operational speed in the present embodiment may be improved. Also, the same effects achieved by one or more of the previous embodiments may be achieved. Also, because pixel circuit 100" is formed of n-channel transistors, the pixel circuit 100" may be applicable to a display device formed of amorphous silicon transistors or oxide semiconductor transistors.

Figure 16:
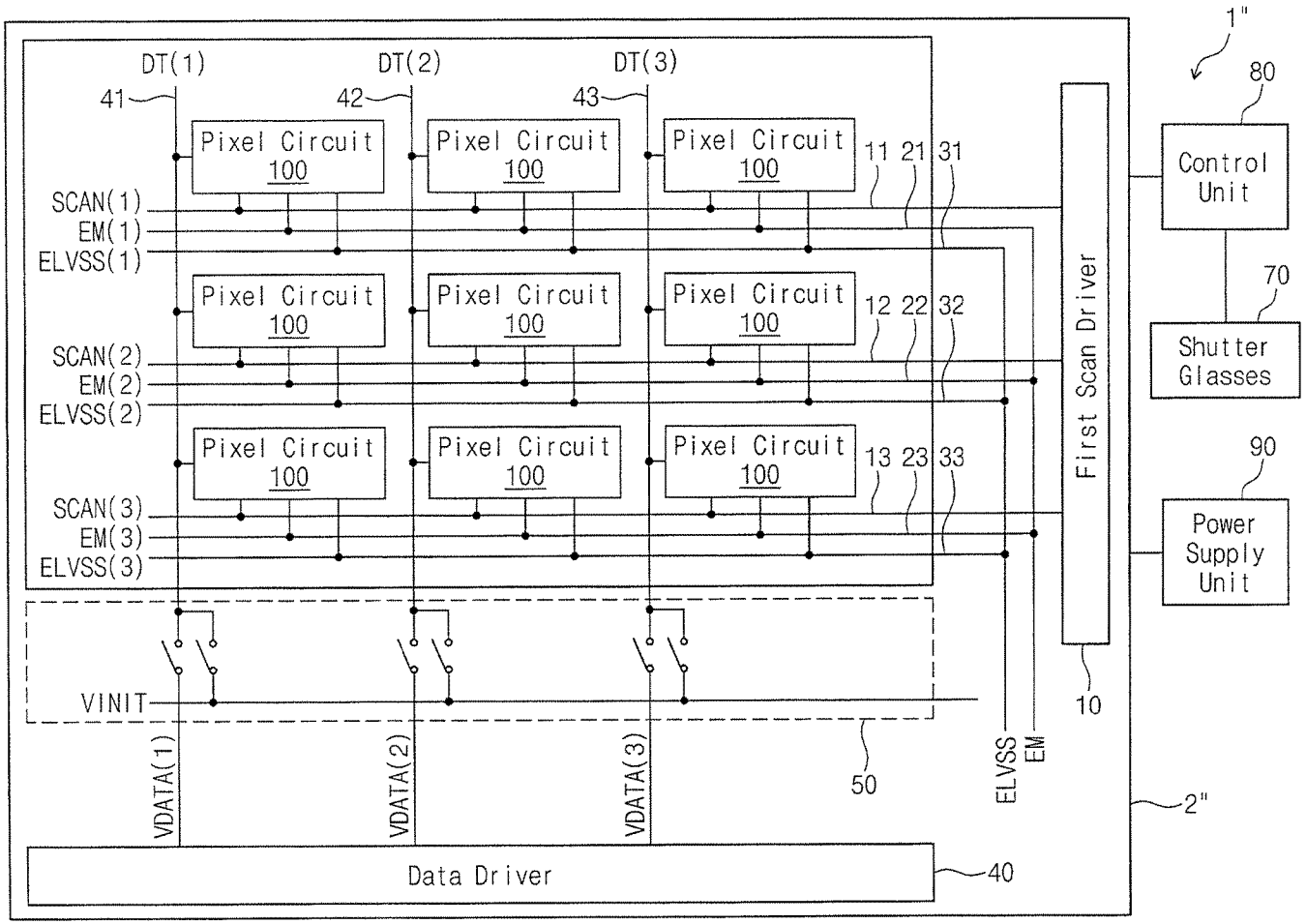
FIG. 16 illustrates another embodiment of a display apparatus.
Figure 17:
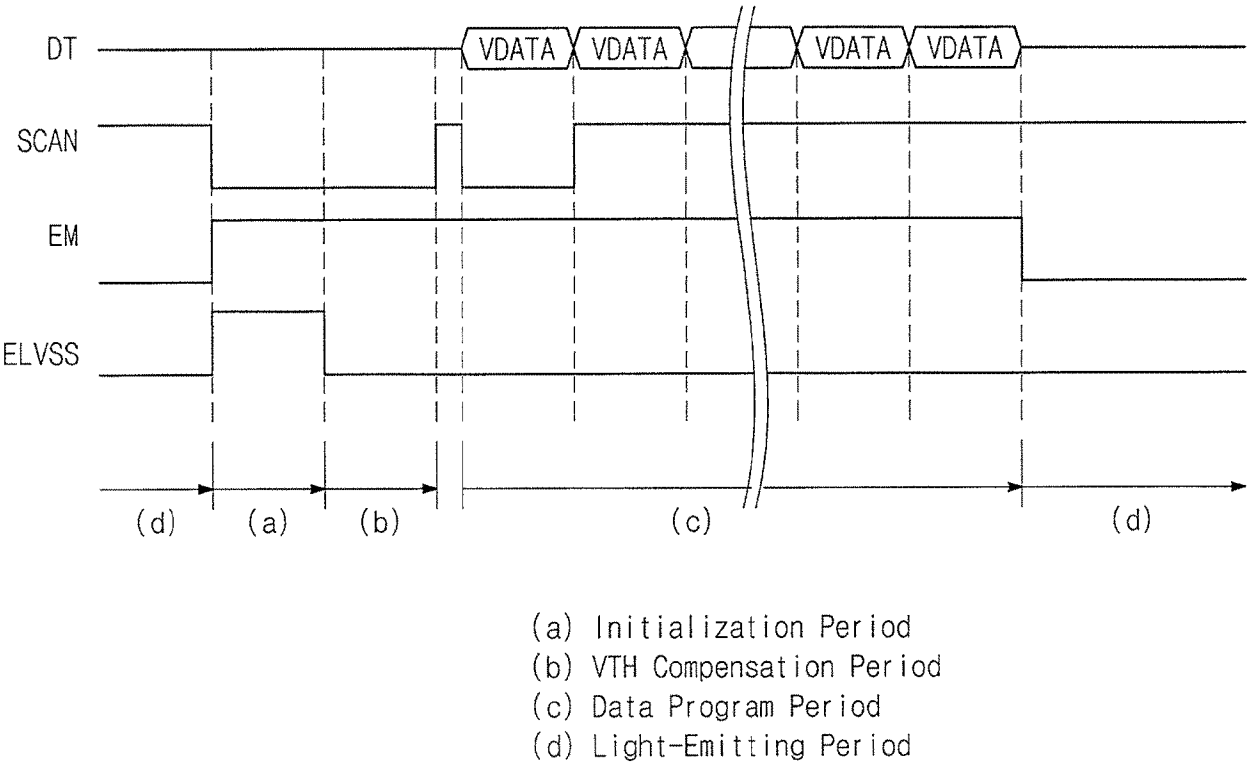
FIG. 17 illustrates a horizontal-period timing diagram for a display apparatus.
Figure 18:
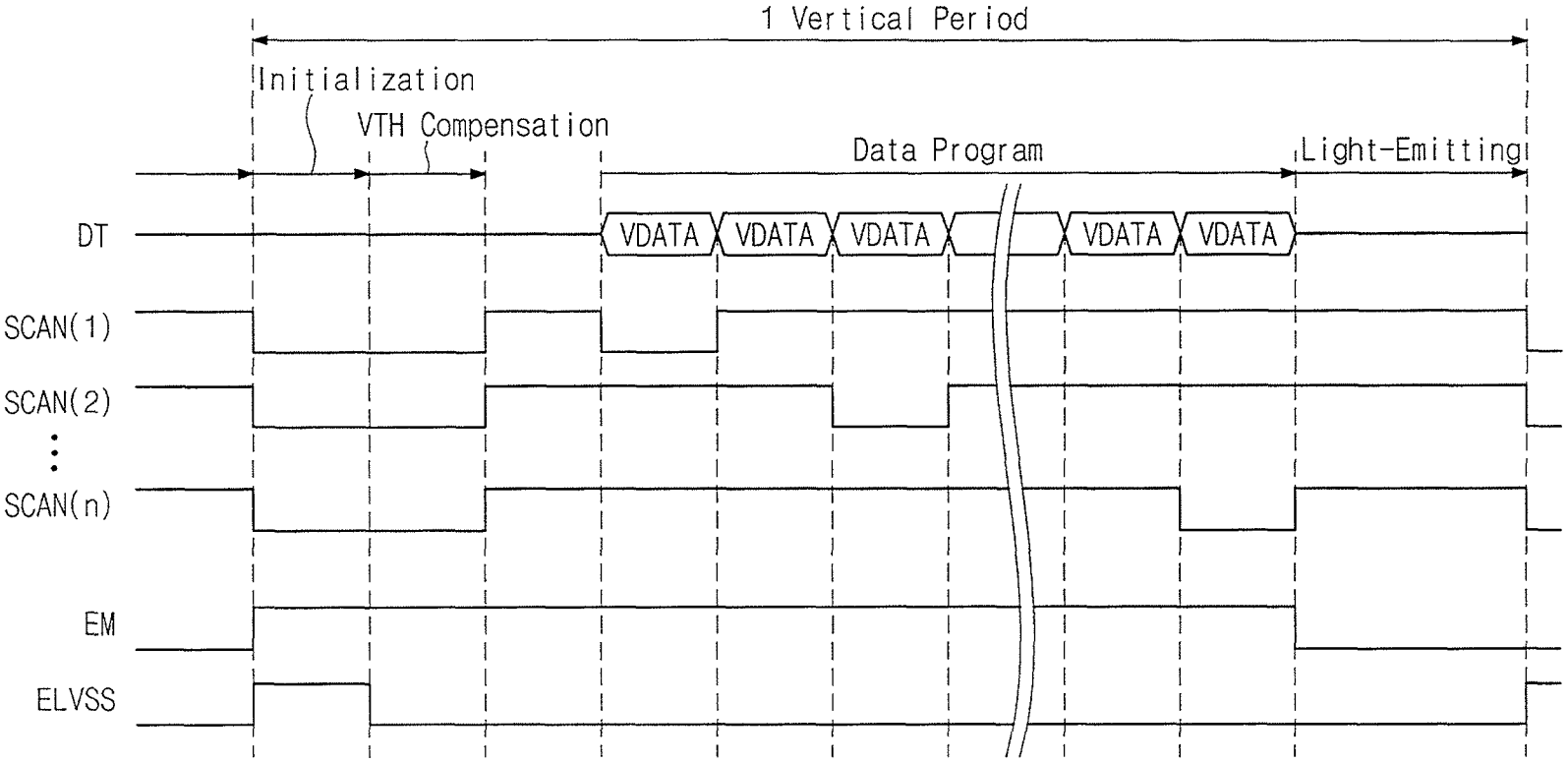
FIG. 18 illustrates a vertical-period timing diagram for a display apparatus.
Figure 19:
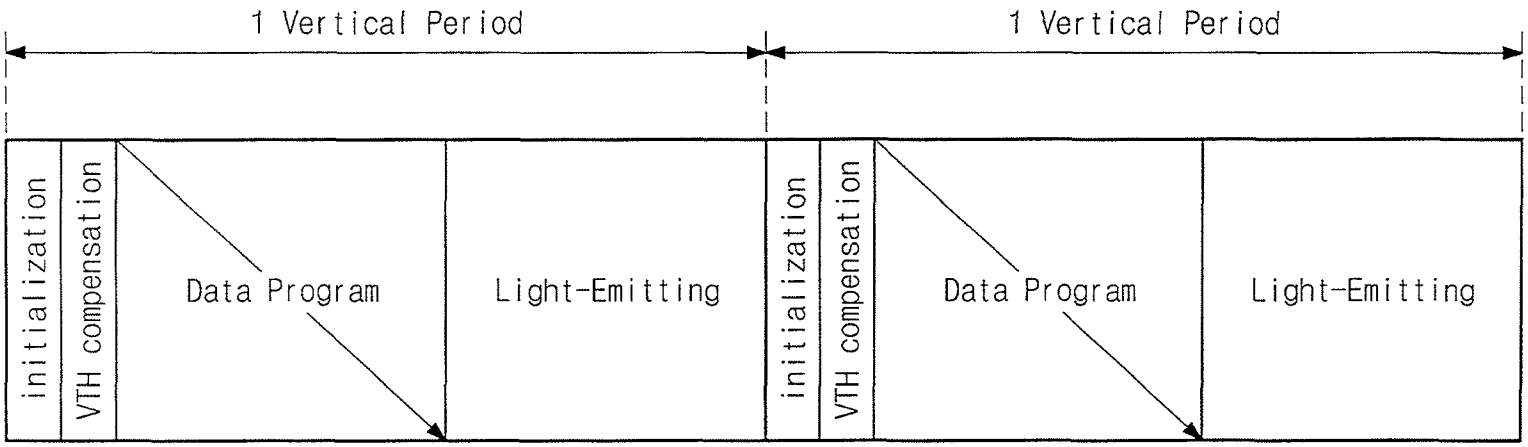
FIG. 19 illustrates an embodiment of a method for driving a display apparatus.

FIG. 16 illustrates another embodiment of an electronic device 1" which includes a light-emitting display apparatus 2". FIG. 17 illustrates a horizontal-period timing diagram for the light-emitting display apparatus. FIG. 18 illustrates a vertical-period timing diagram for the light-emitting display apparatus. FIG. 19 illustrates an embodiment of a method for driving the light-emitting display apparatus 2".

The light-emitting display apparatus 2" in FIG. 16 may be implemented by changing input signals of the light-emitting display apparatus in FIG. 8, under such a condition that it is based on a basic configuration of the light-emitting display apparatus 2 shown in FIG. 8. For example, the light-emitting display apparatus 2" in FIG. 16 may be substantially the same as in FIG. 8, except for a second scan driver 20 and an EL power scan driver 60 and also may perform simultaneous driving by changing input signals. For example, the light-emitting display apparatus 2" in FIG. 16 may be substantially the same as FIG. 8, except that gate control signals EM(n) and ELVSS(n) are provided to the pixel circuits in common, not on a row basis.

Also, unlike previous embodiments, initialization, VTH compensation, data program, and light-emitting operations are simultaneously performed at all pixel circuits 100. As a result, the light-emitting display apparatus 2" is driven in a simultaneously driving manner as illustrated in FIG. 19.

As illustrated in FIGS. 17 and 18, the gate control signals EM(n) and ELVSS(n) are controlled to be provided to all pixel circuits 100 at the same time, not by the row. For example, as illustrated in FIG. 16, because the gate control signals EM(n) and ELVSS(n) are simultaneously provided to pixels, the light-emitting display apparatus 2" in FIG. 16 may not include the second scan driver 20 and the EL power scan driver 60 in FIG. 8. Also, a shutter glasses 70 in FIGS. 8 and 16 may be controlled to be synchronized with a light-emitting display apparatus when a three-dimensional image is displayed.

As described above, control signals may be provided in common to pixel circuits to drive all pixel circuits 100 at the same time. This configuration may allow the second scan driver 20 and the EL power scan driver 60 to be omitted. The size of the scan driver circuit in the display panel of the light-emitting display apparatus may therefore be substantially reduced. Also, because a scan driver is disposed in a non-display area of a display panel area, a narrow frame may be implemented.

The present embodiment may be implemented such that control signals in a light-emitting display apparatus according to the second embodiment of FIG. 8 are used in common and a simultaneous driving operation is performed. Alternatively, the light-emitting display apparatus may be implemented using a light-emitting display apparatus according to one or more other previously described embodiments.

Figure 21:
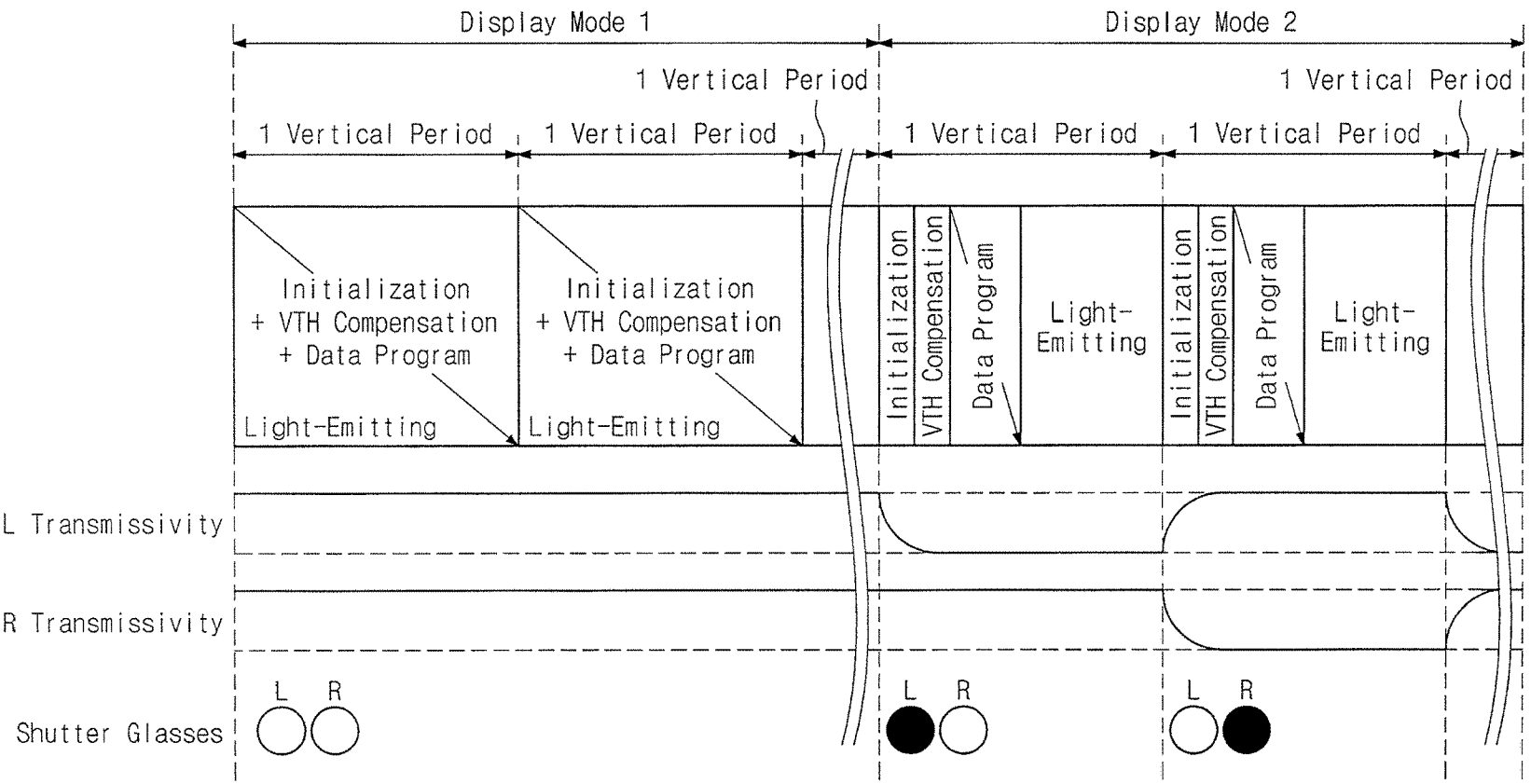
FIG. 21 illustrates an embodiment of a method for driving a display apparatus.

FIG. 20 illustrates a diagram showing display modes according to another embodiment, and FIG. 21 illustrates an embodiment of a method for driving a light-emitting display apparatus that operates in these display modes. In these embodiments, progressive driving and simultaneous driving are modified by input signals in the light-emitting display apparatus 2' in FIG. 8.

Referring to FIG. 20, a light-emitting display apparatus is driven in a progressive driving manner in a display mode 1. Thus, a light-emitting operation and a non-light-emitting operation including initialization, VTH compensation, and data program are performed, in turn, at pixel circuits by the row and sequentially.

The light-emitting display apparatus is driven in a simultaneous driving manner in a display mode 2. Thus, a light-emitting operation and a non-light-emitting operation including initialization, VTH compensation, and data program are performed at all pixel circuits.

A light-emitting duty cycle of a light-emitting element at progressive driving may be greater than that at simultaneous driving. Also, because a level of peak current flowing into a light-emitting element is reduced by progressive driving which is capable of increasing the light-emitting duty cycle, it is possible to increase the lifetime of the light-emitting element that depends on a peak current flowing into the light-emitting element (or, to delay deterioration of luminance).

Under some circumstances, it may not be possible to use progressive driving in a shutter glasses manner as is generally used when expressing a three-dimensional image. In shutter glasses operation, a three-dimensional image may be recognized by displaying a left-eye image and a right-eye image in turn, and simultaneously switching transmittivity of the shutter glasses A three-dimensional image may not be expressed in a driving method (e.g., progressive driving) where a display is not completed in 1 vertical period, e.g., a driving method where an image corresponding to a previous vertical period of the 1 vertical period and an image corresponding to a next vertical period are mixed.

Referring to FIG. 21, progressive driving and simultaneous driving about pixel circuits may be achieved together by changing input signals. For example, if a signal for selecting progressive driving is provided to the control unit 80 connected with a light-emitting display apparatus 2, the control unit 80 controls each driver circuit so as to execute an operation shown in FIGS. 11 and 12. When a signal for selecting the simultaneous driving is provided to the control unit 80, the control unit 80 controls each driver circuit so as to execute an operation shown in FIGS. 17 and 18.

Also, during simultaneous driving, the shutter glasses 70 may be simultaneously controlled by the control unit 80 such that a three-dimensional image is provided. For example, as illustrated in FIG. 21, a right-eye image data is displayed in a first 1-vertical period during simultaneous driving. A right eye and a left eye of the shutter glasses 70 are set to a transmission state and a non-transmission state in synchronization with a display of right-eye image data. Thus, right-eye image data is recognized via the right eye of the shutter glasses 70.

Left-eye image data is displayed in a next 1-vertical period. The left eye and the right eye of the shutter glasses 70 are set to a transmission state and a non-transmission state in synchronization with a display of left-eye image data. Thus, left-eye image data is recognized via the left eye of the shutter glasses 70.

With the above description, a three-dimensional image is provided to a user by providing right-eye image data to the user via the right eye of the shutter glasses 70 and left-eye image data to the user via the left eye of the shutter glasses 70.

Switching between progressive driving and simultaneous driving may be performed by changing signals provided to pixel circuits. Also, a light-emitting display apparatus may be driven using an optimal driving method selected based on display mode.

In the aforementioned embodiments, each pixel circuit is described as having five transistors M1 to M5 and one capacitive element C1. In alternative embodiments, the pixel circuits may have a different number of transistors and/or capacitors. For example, the number of transistors, the number of capacitive elements, or the number of signal lines may increase in order to add additional functionality. For example, in one embodiment, a gray scale data voltage VDATA and an initialization voltage VINIT are provided to a pixel circuit via the same signal line. In another embodiment, the gray scale data voltage VDATA and the initialization voltage VINIT may be provided to a pixel circuit via separate signal lines.

Also, in one or more of the previous embodiments, switching of respective periods (a) to (c) is performed at the same time. Alternatively, the timing of each signal may be postponed or delayed. For example, in an initialization period, an initialization voltage VINIT is provided to a pixel circuit as a data signal DT with a transistor M3 turned on, and current flows from an anode voltage ELVDD to the initialization voltage VINIT. This may cause an increase in power consumption. Thus, in one embodiment, the transistors M2 and M5 may be turned on after the transistor M3 is turned off.

Also, in a light-emitting period, a voltage determined according to a gray scale data voltage charged in a capacitive element C1 and a threshold voltage may be updated when the transistor M3 is turned on before the transistors M2 and M5 are turned off. Thus, in one embodiment, the transistors M2 and M5 may be turned on after the transistor M3 is turned on.

By way of summation and review, in an active matrix panel, the current flowing in the pixels of an organic EL display may vary due to variations in thin film transistor (TFT) characteristics, e.g., variations in the threshold voltages of the driving TFTs. As a result, the brightness of each pixel may vary to thereby lower display quality.

In an effort to suppress a decrease in display quality, threshold voltage compensation techniques have been developed in order to compensate for variations in the threshold voltage of the driving transistor in each pixel. These techniques include using a constant current circuit in each EL pixel.

For example, in one related-art technique, pixels are driven in various periods, e.g., an initialization period, a threshold voltage (VTH) compensation period, a data program period, and a light-emitting (or, emission) period. These pixels have four transistors, two capacitive elements, and a light-emitting element. In another related-art technique, pixels are driven in an initialization period, a threshold voltage (VTH) compensation period, a data program period, and a light-emitting (or, emission) period. These pixels have three transistors and two capacitive elements.

However, in these related-art techniques, a threshold voltage compensation operation and a data program operation may not be performed at the same time. Thus, each pixel circuit needs two capacitive elements because a program operation must be performed through capacitive coupling with another pixel circuit after a threshold voltage compensation operation is first carried out to charge a VTH voltage of a driving transistor. As a result, a circuit layout ratio of these pixel circuits increases, thereby making it difficult to achieve high resolution.

In accordance with one or more of the aforementioned embodiments, a light-emitting display apparatus is provided which achieves high resolution and at the same time reduces the number of capacitive elements in each pixel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method for driving a display apparatus, the method comprising:

charging an initialization voltage in a capacitive element of a pixel circuit;

charging the capacitive element with a first data voltage determined based on a gray scale data voltage and a threshold voltage of a first transistor in the pixel circuit; and supplying a light-emitting element in the pixel circuit with current, corresponding to the first data voltage charged in the capacitive element, for causing the light-emitting element to emit light, wherein the first transistor controls a magnitude of the current supplied to the light-emitting element and has a first terminal connected to one terminal of the light-emitting element and a second terminal connected to a first electrode of the capacitive element, and wherein the pixel circuit includes:

a second transistor connected between a gate electrode of the first transistor and a first power supply, a third transistor having a first terminal connected to the gate electrode of the first transistor and a second terminal connected to a second electrode of the capacitive element, a fourth transistor connected between the second terminal of the first transistor and a second power supply, and a fifth transistor connected between the second terminal of the third transistor and a signal line supplied with the initialization voltage and the gray scale data voltage.

2. The method as claimed in claim 1, further comprising:

charging the capacitive element with a voltage determined according to the threshold voltage before charging the capacitive element with the first data voltage.

3. The method as claimed in claim 2, wherein charging the capacitive element with the voltage determined according to the threshold voltage is performed multiple times between charging the initialization voltage in the capacitive element and the light-emitting of the light-emitting element.

4. The method as claimed in claim 2, wherein, after charging the initialization voltage in the capacitive element, the method includes varying a voltage of the first power supply, turning off the first transistor, and charging the capacitive element with the voltage determined according to the threshold voltage.

5. The method as claimed in claim 1, wherein charging the initialization voltage in the capacitive element includes:

turning off the third transistor;

turning on the second transistor after the third transistor is turned off;

supplying a voltage of the first power supply for turning off the first transistor to the gate electrode of the first transistor, and turning on the fourth and fifth transistors such that a voltage at the second power supply and the initialization voltage are supplied to both electrodes of the capacitive element.

6. The method as claimed in claim 1, wherein another terminal of the light-emitting element is connected to a third power supply, and wherein charging the initialization voltage in the capacitive element includes:

turning off the third transistor;

turning on the fifth transistor after the third transistor is turned off;

supplying a voltage at the third power supply to one terminal of the capacitive element, turning on the second transistor, and supplying a voltage at the first power supply to the gate electrode of the first transistor, and wherein a voltage at the third power supply is varied, the first transistor is turned on by capacitive coupling of a capacitance of the light-emitting element, and the initialization is charged in the capacitive element.

7. The method as claimed in claim 1, wherein, during a period of charging the first data voltage, the method includes supplying the gray scale data voltage to the capacitive element via the fifth transistor and charging the first data voltage in the capacitive element.

8. The method as claimed in claim 1, wherein, during emission of the light-emitting element, the method includes turning on the third transistor after the second and fifth transistors are turned off, and turning on the fourth transistor after the third transistor is turned on.

9. The method as claimed in claim 1, wherein the display apparatus includes a plurality of pixel circuits in a matrix, and wherein the method includes:

driving the pixel circuits in a progressive manner by sequentially performing a non-light-emitting operation and a light-emitting operation by rows, the non-light emitting operation including charging the capacitive element with the initialization voltage and charging the first data voltage, and the light-emitting operation including the light-emitting of the light-emitting element.

10. The method as claimed in claim 1, wherein the display apparatus includes a plurality of pixel circuits in a matrix, and wherein the method includes:

driving the pixel circuits in a simultaneous manner which includes performing a non-light-emitting operation and a light-emitting operation for all pixels, the non-light emitting operation including charging the capacitive element with the initialization voltage and charging the first data voltage, and the light-emitting operation including the light-emitting of the light-emitting element.

11. The method as claimed in claim 1, wherein the display apparatus includes a plurality of pixel circuits arranged in a matrix, and wherein the method includes:

switching between a progressive driving method and a simultaneous driving method based on an input switch signal, the progressive driving method including a non-light-emitting operation sequentially performed by rows and a light-emitting operation, the non-light-emitting operation including charging the capacitive element with the initialization voltage and charging the first data voltage, and the light-emitting operation including light-emitting of the light-emitting element, and the simultaneous driving method including a non-light-emitting operation and a light-emitting operation performed for all pixels, the non-light emitting operation including charging the capacitive element with the initialization voltage and charging the first data voltage, and the light-emitting operation including light-emitting of the light-emitting element.

12. A light-emitting display apparatus, comprising:

a light-emitting element including a parasitic capacitance, the light-emitting element to emit light having a gray scale value based on a supplied current;

a first transistor to control a magnitude of current to be supplied to the light-emitting element, and having a first terminal connected to one terminal of the light-emitting element and a second terminal connected to a first electrode of a capacitive element;

a second transistor connected between a gate electrode of the first transistor and a first power supply;

a third transistor having a first terminal connected to the gate electrode of the first transistor and a second terminal connected to a second electrode of the capacitive element;

a fourth transistor connected between the second terminal of the first transistor and a second power supply; and a fifth transistor connected between the second terminal of the third transistor and a signal line to receive an initialization voltage and a gray scale data voltage.

13. The apparatus as claimed in claim 12, wherein a voltage of the first power supply and a voltage of the second power supply are supplied via a same power line.

14. The apparatus as claimed in claim 12, wherein a gate electrode of the third transistor and a gate electrode of the fourth transistor are connected to a same control line.

15. The apparatus as claimed in claim 12, wherein a gate electrode of the second transistor and a gate electrode of the fifth transistor are connected to a same control line.

16. A pixel, comprising:

a capacitor having a first electrode and a second electrode;

a first transistor to control a magnitude of current to be supplied to a light-emitting element and having a first terminal connected to one terminal of the light-emitting element and a second terminal connected to the first electrode of the capacitor;

a second transistor connected between a gate electrode of the first transistor and a first power supply;

a third transistor having a first terminal connected to the the gate electrode of the first transistor and a second terminal connected to the second electrode of the capacitor;

a fourth transistor connected between the second terminal of the first transistor and a second power supply; and a fifth transistor connected between the second terminal of the third transistor and a signal line, wherein the capacitor is the only capacitor in the pixel and wherein the signal line is to receive an initialization voltage and a gray scale data voltage.

17. The pixel as claimed in claim 16, wherein a voltage of the first power supply and a voltage of the second power supply are supplied via a same power line.

18. The pixel as claimed in claim 16, wherein a gate electrode of the third transistor and a gate electrode of the fourth transistor are connected to a same control line.

19. The pixel as claimed in claim 16, wherein a gate electrode of the second transistor and a gate electrode of the fifth transistor are connected to a same control line.

20. The pixel as claimed in claim 16, wherein the capacitor is coupled to an initialization during a first period and a data voltage in a second period after the first period.

* * * * *